US008295753B2

(12) United States Patent
Kagawa

(10) Patent No.: US 8,295,753 B2
(45) Date of Patent: Oct. 23, 2012

(54) FIXING DEVICE HAVING AN ENDLESS FIXING BELT AND TWO-POSITION DISJUNCTION MECHANISM

(75) Inventor: Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 330 days.

(21) Appl. No.: 12/759,655

(22) Filed: Apr. 13, 2010

(65) Prior Publication Data

US 2010/0266307 A1 Oct. 21, 2010

(30) Foreign Application Priority Data

Apr. 20, 2009 (JP) ..... 2009-102048

(51) Int. Cl.
*G03G 15/20* (2006.01)

(52) U.S. Cl. ..... 399/329; 399/70

(58) Field of Classification Search ..... 399/328, 399/329, 70; 219/216, 469–471
See application file for complete search history.

(56) References Cited

U.S. PATENT DOCUMENTS 5,111,250 A * 5/1992 Kashiwagi ..... 219/216
6,243,559 B1 6/2001 Kurotaka et al.
7,003,254 B2 * 2/2006 Tokuzaki ..... 399/328
7,639,978 B2 * 12/2009 Fujisawa ..... 399/329
2006/0067753 A1 * 3/2006 Katayanagi ..... 399/329
2007/0230982 A1 10/2007 Hori et al.

FOREIGN PATENT DOCUMENTS

JP 10-307496 A 11/1998
JP 11-327349 A 11/1999
JP 2002-333788 A 11/2002
JP 2005-031182 A 2/2005
JP 2006-259299 A 9/2006
JP 2007-264318 A 10/2007
JP 2009-063680 A 3/2009
JP 2009-063861 A 3/2009

* cited by examiner

*Primary Examiner* — Susan Lee
(74) *Attorney, Agent, or Firm* — Renner, Otto, Boisselle & Sklar, LLP

(57) ABSTRACT

A fixing device having a fixing belt which satisfies $42.2 \geqq ER \geqq 0.1044 \times D \times \mu^{-0.5174}$, where: D represents an inner diameter of the fixing belt; A represents a second inner diameter of the fixing belt; ER represents an elongation rate of the fixing belt and is formulated as $ER=(A-D)/D \times 100$; and $\mu$ represents a coefficient of kinetic friction between the fixing belt and the fixing roller. The fixing device is thus arranged so that the fixing belt is driven by the fixing roller to rotate in a state where the pressing roller is separated from the fixing belt. This makes it possible to lengthen a life of a fixing belt, to shorten a warm-up time, and to reduce power consumption in a fixing device using a belt fixing method.

11 Claims, 11 Drawing Sheets

FIG. 3

| SAMPLE GROUP No. | SAMPLE No. | FIXING BELT ARRANGEMENT | | | DIAMETER D (mm) | FIXING BELT WIDTH (mm) | LOAD PER UNIT LENGTH (g/mm) | LONGITUDINAL DIAMETER UNDER LOAD A (mm) | ELONGATION RATE ER (%) | RESULT | | |
|---|---|---|---|---|---|---|---|---|---|---|---|---|
| | | SUBSTRATE | ELASTIC LAYER | RELEASING LAYER | | | | | | $\mu$=0.2 | $\mu$=0.55 | $\mu$=0.75 |
| 1 | 1-1 | PI 130$\mu$m | Si RUBBER 150$\mu$m | PFA TUBE 30$\mu$m | 35 | 230 | 0.383 | 36 | 2.9 | P | P | P |
| | 1-2 | | | | 50 | 320 | 0.383 | 52 | 4.0 | P | P | P |
| | 1-3 | | | | 65 | 320 | 0.383 | 68.5 | 5.4 | P | P | P |
| 2 | 2-1 | PI 110$\mu$m | Si RUBBER 150$\mu$m | PFA TUBE 30$\mu$m | 35 | 230 | 0.383 | 36.5 | 4.3 | P | P | G |
| | 2-2 | | | | 50 | 320 | 0.383 | 53 | 6.0 | P | P | G |
| | 2-3 | | | | 65 | 320 | 0.383 | 70 | 7.7 | P | P | G |
| 3 | 3-1 | PI 110$\mu$m | Si RUBBER 150$\mu$m | PTFE COAT 20$\mu$m | 35 | 230 | 0.383 | 37 | 5.7 | P | G | G |
| | 3-2 | | | | 50 | 320 | 0.383 | 53.5 | 7.0 | P | G | G |
| | 3-3 | | | | 65 | 320 | 0.383 | 71 | 9.2 | P | G | G |
| 4 | 4-1 | PI 90$\mu$m | Si RUBBER 150$\mu$m | PFA TUBE 30$\mu$m | 35 | 230 | 0.383 | 38 | 8.6 | G | G | G |
| | 4-2 | | | | 50 | 320 | 0.383 | 56 | 12.0 | G | G | G |
| | 4-3 | | | | 65 | 320 | 0.383 | 75 | 15.4 | G | G | G |
| 5 | 5-1 | PI 90$\mu$m | Si RUBBER 150$\mu$m | PTFE COAT 20$\mu$m | 35 | 230 | 0.383 | 38.5 | 10.0 | G | G | G |
| | 5-2 | | | | 50 | 320 | 0.383 | 57 | 14.0 | G | G | G |
| | 5-3 | | | | 65 | 320 | 0.383 | 76.5 | 17.7 | G | G | G |
| 6 | 6-1 | PI 70$\mu$m | Si RUBBER 150$\mu$m | PFA TUBE 30$\mu$m | 35 | 230 | 0.383 | 40 | 14.3 | G | G | G |
| | 6-2 | | | | 50 | 320 | 0.383 | 60 | 20.0 | G | G | G |
| | 6-3 | | | | 65 | 320 | 0.383 | 81.5 | 25.4 | G | G | G |

FIG. 5

| | ELASTIC LAYER | COEFFICIENT $\mu$ OF KINETIC FRICTION |
|---|---|---|
| FIXING ROLLER (1) | SILICON SPONGE RUBBER (5 mm IN THICKNESS) + PFA TUBE (30 $\mu$m IN THICKNESS) | 0.20 |
| FIXING ROLLER (2) | SILICON SPONGE RUBBER (5 mm IN THICKNESS) | 0.55 |
| FIXING ROLLER (3) | SOLID SILICON RUBBER (5 mm IN THICKNESS) | 0.75 |

FIG. 8

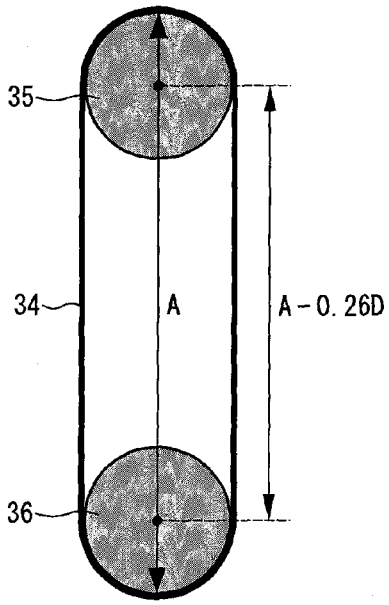

FIG. 9

| PROCESSING MODE | AUTOMATIC PRESSURE REMOVING MECHANISM | FIXING ROLLER DRIVING MEANS | FIXING BELT CONTROL TEMPERATURE | FIXING ROLLER CONTROL TEMPERATURE | PRESSING ROLLER CONTROL TEMPERATURE |
|---|---|---|---|---|---|
| WARM-UP | ON | ON | 175°C | — | 120°C |
| PAPER CARRYING | OFF | ON | 175°C | — | 120°C |
| STANDBY | ON | ON/OFF※ | 175°C | 150°C | 120°C |

※ ON WHEN FIXING ROLLER HAS TEMPERATURE OF LOWER THAN 150°C, AND OFF WHEN FIXING ROLLER HAS TEMPERATURE OF NOT LOWER THAN 150°C

FIXING DEVICE HAVING AN ENDLESS FIXING BELT AND TWO-POSITION DISJUNCTION MECHANISM

This Nonprovisional application claims priority under 35 U.S.C. §119(a) on Patent Application No. 2009-102048 filed in Japan on Apr. 20, 2009, the entire contents of which are hereby incorporated by reference

TECHNICAL FIELD

The present invention relates to a fixing device included in an electrophotographic image forming apparatus, and to an image forming apparatus including the fixing device.

BACKGROUND ART

In recent years, as a fixing device included in an electrophotographic image forming apparatus such as a copying machine and a printer, a fixing device using a belt fixing method has increasingly been used. In this method, a fixing belt is held around a fixing roller and a heat roller, and the fixing roller and a pressing roller are pressed against each other via the fixing belt (see Patent Literature 1).

In the fixing device using the belt fixing method, the fixing belt having a heat capacity smaller than a heat capacity of the fixing roller is heated. Thus, the fixing device has an advantage of a short warm-up time as compared to a fixing device in which a fixing roller and a pressing roller directly abut each other. In addition, the fixing device using the belt fixing method does not require a heat source such as a halogen lamp inside the fixing roller. This allows the fixing roller to be provided with a thick elastic layer which is made of, e.g., sponge rubber and which has a low hardness. Consequently, it is possible to advantageously secure a large nip width.

However, in the case where the fixing device using the belt fixing method has a fixing roller provided with an elastic layer having a large thickness and a low hardness, since the fixing roller cannot contain a heat source, it is impossible to heat the fixing roller in a state where the fixing belt is not being rotated. Consequently, in a case where continuous printing is started in a state where the fixing roller is not heated sufficiently, e.g., immediately after a warm-up or when the image forming apparatus is ready on standby, heat of the fixing belt is rapidly drawn to the fixing roller, so that the fixing belt is caused to have a temperature lower than a fixing temperature. In other words, an undershoot occurs. This problematically leads to defective fixing.

To solve this problem, according to a conventional fixing device using the belt fixing method, the fixing belt is driven to rotate even during a warm-up or when the image forming apparatus is ready on standby. This allows heat of the heat roller to be provided to the fixing roller via the fixing belt, so that the fixing roller is heated.

However, in the case where the fixing belt of the conventional fixing device using the belt fixing method is driven to rotate, respective abutting surfaces of the fixing roller and the fixing belt slip on each other due to rigidity of the fixing belt. This makes it difficult to appropriately rotate the fixing belt only by driving the fixing roller to rotate. Thus, it has been necessary to (i) press the fixing roller and the pressing roller against each other via the fixing belt so that the fixing belt is sandwiched between the two rollers, and in this state to (ii) drive both of the pressing roller and the fixing roller to rotate so that the fixing belt is rotated. This method, however, has caused problems (1) and (2) below.

(1) Since the pressing roller is driven to rotate while being constantly pressed with great force against a surface of the fixing belt during a warm-up or when the image forming apparatus is ready on standby, the fixing belt is easily deteriorated, and thus has a shortened life. In particular, an image forming apparatus for normal use is ready on standby for a period far longer than a period during which the image forming apparatus is carrying paper. Therefore, the above rotation under pressure affects the fixing belt significantly.

(2) The pressing roller is pressed against the fixing belt that has a set temperature higher than that of the pressing roller. This excessively raises a temperature of the pressing roller. Thus, even if the pressing roller is provided with a heat source and a temperature sensor so as to control the temperature of the pressing roller, it is still difficult to control the temperature so that the pressing roller has a predetermine temperature.

Patent Literature 2 discloses, as a technique for solving the above problems, a fixing device including an auxiliary roller for driving a fixing belt to rotate.

CITATION LIST

Patent Literature 1

Japanese Patent Application Publication, Tokukaihei, No. 10-307496 A (Publication Date: Nov. 17, 1998)

Patent Literature 2

Japanese Patent Application Publication, Tokukai, No. 2005-31182 A (Publication Date: Feb. 3, 2005)

SUMMARY OF INVENTION

Technical Problem

The technique disclosed in Patent Literature 2, however, requires including the auxiliary roller and a mechanism for making the auxiliary roller disjunctive with respect to a surface of the fixing belt. This problematically complicates an arrangement of the fixing device, and thus increases a cost of producing the fixing device. Furthermore, the above technique causes heat of the fixing belt to be drawn to the auxiliary roller. This problematically increases a warm-up time, and thus increases power consumed during a warm-up or when the image forming apparatus is ready on standby.

The present invention has been accomplished in view of the above problems. It is an object of the present invention to lengthen a life of a fixing belt, to shorten a warm-up time, and to reduce power consumption in a fixing device using a belt fixing method.

Solution to Problem

In order to solve the above problems, a fixing device of the present invention includes: a fixing roller which is rotatably supported; a belt holding member; a fixing belt which is endless and which is rotatably held around the fixing roller and the belt holding member; first heating means for heating the fixing belt; a pressing member which is capable of being pressed against the fixing roller via the fixing belt; first driving means for driving the fixing roller to rotate; and a disjunction mechanism for switching a relative position of the pressing member and the fixing roller from a first position to a second position, or vice versa, the first position being a position at which the pressing member and the fixing roller are pressed against each other via the fixing belt, the second position being a position at which the pressing member and the fixing belt are separated from each other; the fixing device fixing an unfixed toner image, formed on a recording material, to the recording material by causing the recording material to pass through a nip at which the fixing belt and the pressing member are pressed against each other, the fixing belt satisfying $$42.2 \geqq ER \geqq 0.1044 \times D \times \mu^{-0.5174},$$

where: D (mm) represents a first inner diameter of a loop of the fixing belt held in a state where the fixing belt is looped in a shape of a circle without suspension; A (mm) represents a second inner diameter of the fixing belt, the second inner diameter being a distance between respective axial centers of a supporting member and a spindle in a state where the fixing belt is held with a tensile load of 0.383 gf/mm by (i) suspending the fixing belt from the supporting member inserted in a loop of the fixing belt, and (ii) further inserting the spindle in the loop of the fixing belt, the supporting member and the spindle having a shape of a roller with a diameter of 0.26×D (mm); ER represents an elongation rate (%) of the fixing belt and is formulated as $$ER=(A-D)/D \times 100; \text{ and}$$

μ represents a coefficient of kinetic friction between the fixing belt and the fixing roller, the fixing belt being driven by the fixing roller to rotate in a case where the fixing roller is driven by the first driving means to rotate in a state where the relative position is set to the second position.

According to the above arrangement, the fixing belt satisfies $42.2 \geqq ER \geqq 0.1044 \times D \times \mu^{-0.5174}$. The fixing belt satisfying this condition can be driven by the fixing roller to rotate in the case where the fixing roller is driven by the first driving means to rotate in the state where the relative position is set to the second position.

The above arrangement allows the pressing member to be separated from the fixing belt when no recording material is passed through the nip. This prevents the fixing belt from being damaged due to its abutment on the pressing member, and can in turn allow the fixing belt to have a longer life. The above arrangement, even without providing an auxiliary roller as in Patent Literature 2, allows the fixing belt to be driven by the fixing roller to rotate in the state where the pressing member is separated from the fixing belt. This prevents heat of the fixing belt from being drawn to such an auxiliary roller. Consequently, it is possible to shorten a warm-up time and to reduce power consumption. In addition, the above arrangement allows heat transferred from the first heating means to the fixing belt to be transferred uniformly over a surface of the fixing roller so that the fixing roller is heated. This prevents a temperature of the fixing roller from decreasing when no recording material is passed through the nip. As a result, it is possible to stabilize a fixing property observed immediately after a warm-up or immediately after the image forming apparatus becomes ready on standby.

Advantageous Effects of Invention

As described above, according to the fixing device of the present invention, the fixing belt satisfies $42.2 \geqq ER \geqq 0.1044 \times D \times \mu^{-0.5174}$. The fixing belt is thus driven by the fixing roller to rotate in the case where the fixing roller is driven by the first driving means to rotate in the state where the relative position is set to the second position.

This makes it possible not only to allow the fixing belt to have a longer life, but also to shorten the warm-up time and thus to reduce the power consumption.

BRIEF DESCRIPTION OF DRAWINGS

FIG. 3 is a table showing conditions and results of an experiment conducted on a fixing belt included in the fixing device illustrated in FIG. 1.

FIG. 4(*b*) is a view explaining how the elongation rate ER (%) of the fixing belt is defined.

FIG. 5 is a table showing (i) different arrangements of the fixing roller used in the experiment and (ii) corresponding coefficients μ of kinetic friction.

FIG. 8 is an explanatory view illustrating how a maximum value of the elongation rate ER (%) of the fixing belt is defined.

FIG. 9 is a table showing how each section of the fixing device illustrated in FIG. 1 is controlled.

DESCRIPTION OF EMBODIMENTS

[Embodiment 1]

The following describes an embodiment of the present invention. The present embodiment describes a case in which the present invention is applied to a multifunction color printer.

Figure 2:
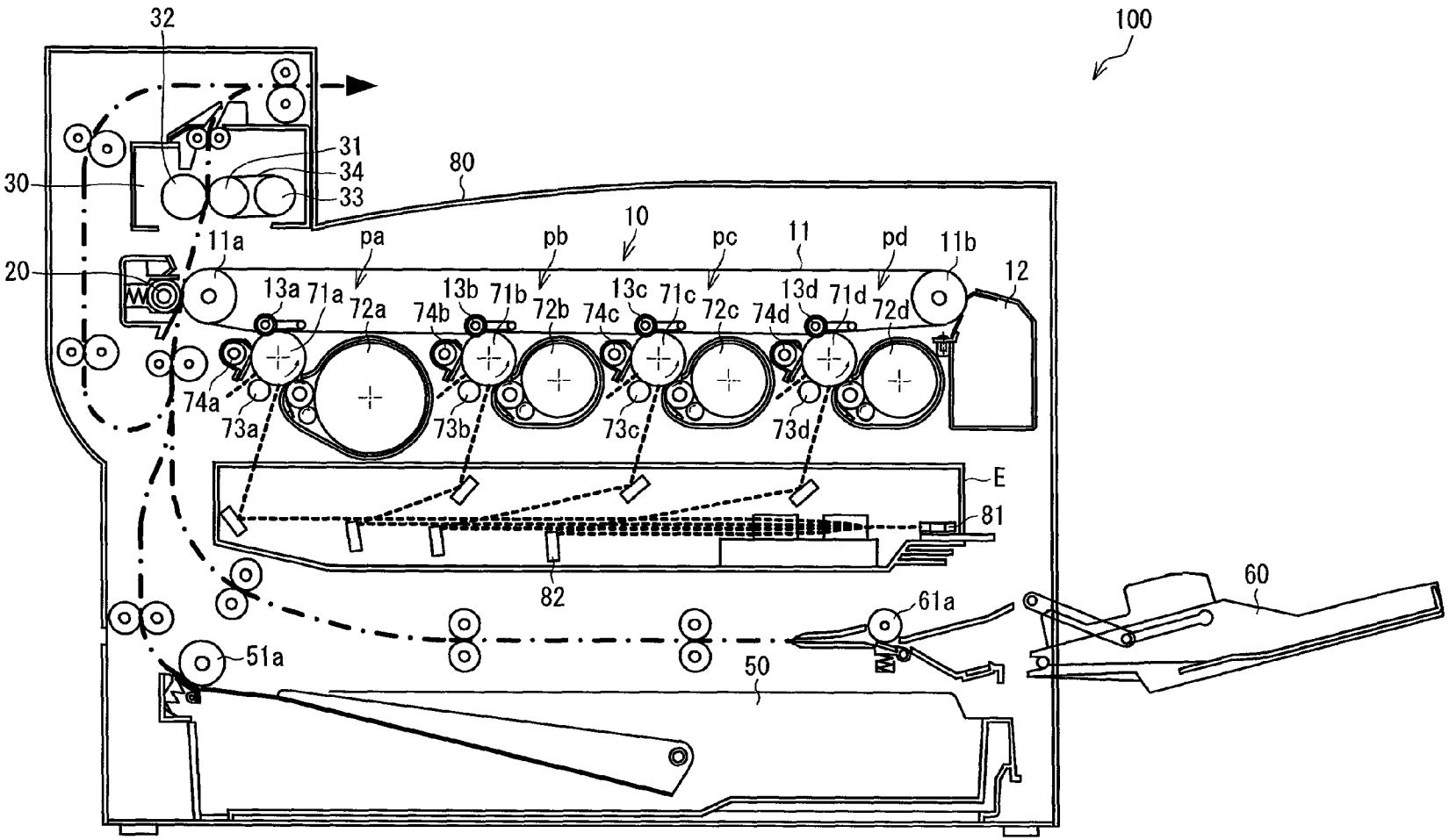
FIG. 2 is a cross-sectional view illustrating an arrangement of an image forming apparatus including the fixing device illustrated in FIG. 1.

FIG. 2 is a cross-sectional view illustrating an image forming apparatus (multifunction color printer) 100 of the present embodiment. As illustrated in FIG. 2, the image forming apparatus 100 includes: an optical system (exposure) unit E; four sets of visible image forming units pa through pd; an intermediate transfer unit 10 including an intermediate transfer belt 11; a second transfer unit 20; a fixing unit (fixing device) 30; an internal paper feeding unit 50; and a manual paper feeding unit 60. Each member included in the image forming apparatus 100 is operated as controlled by a main control section (not shown) including components such as a CPU.

The visible image forming units pa through pd form toner images of black (K), cyan (C), magenta (M), and yellow (Y), respectively, and also transfer the toner images on the intermediate transfer belt 11 so that the toner images are laid on top of one another.

The visible image forming unit pa includes a photoreceptor drum (toner image bearing member) 71*a* which is rotatably provided, and further includes, around the photoreceptor drum 71*a*, a charging unit 73*a*, a developing unit 72*a*, and a cleaning unit 74*a* successively along a direction in which the photoreceptor drum 71*a* is rotated.

The charging unit 73*a* charges a surface of the photoreceptor drum 71*a* uniformly so that the surface has a predetermined potential. The present embodiment uses, as the charging unit 73*a*, a charging device of a charging roller type (contact charging type). However, an arrangement of the charging unit 73*a* is not limited to this. Instead, the charging unit 73*a* may, for example, be a charging device of a non-contact type, e.g., a corona discharge type, or a charging device of a contact type, e.g., a brush charging type.

The optical system (exposure) unit E exposes respective surfaces of the photoreceptor drums 71*a* through 71*d* in correspondence with image data, which surfaces have been charged by the charging units 73*a* through 73*d*, respectively. An electrostatic latent image is thus formed on the surface of each of the photoreceptor drums 71*a* through 71*d*, which electrostatic latent image corresponds to the image data. The optical system (exposure) unit E is constituted by a laser scanning unit (LSU) including a light source 81, reflection mirrors 82 and the like. Alternatively, the optical system (exposure) unit E may, for example, be constituted by an EL or LED writing head in which light-emitting elements are arranged in an array shape.

The developing unit 72*a* performs a developing process in which the electrostatic latent image formed on the photoreceptor drum 71*a* is made visible with a toner. The toner may, for example, be a one-component nonmagnetic developer (including a nonmagnetic toner), a two-component nonmagnetic developer (including a nonmagnetic toner and a carrier), or a magnetic developer (including a magnetic toner). As illustrated in FIG. 2, in the present embodiment, the developing unit 72*a* included in the visible image forming unit pa for forming black toner images has a capacity larger than a capacity of any of the developing units 72*b* through 72*d* included respectively in the visible image forming units pb through pd for forming toner images of the other colors. An arrangement of the developing units 72*a* through 72*d* is, however, not limited to this. Thus, the developing units 72*a* through 72*d* may all have an equal capacity.

The toner image, which results from making the electrostatic latent image visible by the developing unit 72*a*, is transferred onto the intermediate transfer belt 11 with use of an intermediate transfer roller 13*a* included in the intermediate transfer unit 10.

The cleaning unit 74*a* removes and gathers toner which remains on the surface of the photoreceptor drum 71*a* after the toner image is transferred onto the intermediate transfer belt 11.

Each of the visible image forming units pb through pd has an arrangement substantially identical to that of the visible image forming unit pa, except for the color of the toner used for the developing process. Specifically, the developing units 72*a* through 72*d* included respectively in the visible image forming units pa through pd contain toners of black (B), yellow (Y), magenta (M), and cyan (C), respectively.

The intermediate transfer unit 10 includes: an intermediate transfer belt 11; an intermediate transfer belt driving roller (tension roller) 11*a*; an intermediate transfer belt driven roller (tension roller) 11*b*; an intermediate transfer belt cleaning unit 12; and intermediate transfer rollers 13*a* through 13*d*.

The intermediate transfer belt 11 is an endless belt, and is held around the intermediate transfer rollers 13*a* through 13*d*, the intermediate transfer belt driving roller 11*a*, and the intermediate transfer belt driven roller 11*b*. The intermediate transfer belt 11 is thus driven to rotate. The toner images having the respective colors and formed respectively on the photoreceptor drums 71*a* through 71*d* are sequentially transferred onto the intermediate transfer belt 11 so as to be laid on top of one another. This allows a color toner image (multicolor toner image) to be formed on the intermediate transfer belt 11.

Each of the intermediate transfer rollers 13*a* through 13*d* is provided so as to face, via the intermediate transfer belt 11, a corresponding one of the photoreceptor drums 71*a* through 71*d* at a position between (i) a position at which the corresponding one of the photoreceptor drums 71*a* through 71*d* faces a corresponding one of the developing units 72*a* through 72*d* and (ii) a position at which the corresponding one of the photoreceptor drums 71*a* through 71*d* faces a corresponding one of the cleaning units 74*a* through 74*d*. A high voltage having a polarity (+) reverse to a polarity (−) of an electrical charge of the toner is applied to the intermediate transfer rollers 13*a* through 13*d*. This allows the toner images on the photoreceptor drums 71*a* through 71*d* to be transferred onto the intermediate transfer belt 11 so that the toner images are laid on top of one another.

The toner image thus formed on the intermediate transfer belt 11 is carried to a position at which the intermediate transfer belt driving roller 11*a* faces the second transfer unit 20, so that the toner image is transferred onto a recording material, such as recording paper, which has been carried to this position. The intermediate transfer belt cleaning unit 12 abuts the intermediate transfer belt 11, and thus removes and gathers toner which remains on the intermediate transfer belt 11 after the toner image is transferred onto the recording material as described above.

The fixing unit 30 includes: a fixing roller 31; a heat roller 33; a fixing belt 34, which is held around the fixing roller 31 and the heat roller 33; and a pressing roller (pressing member) 32, which is capable of being pressed by a predetermined load against the fixing roller 31 via the fixing belt 34. The fixing unit 30 is provided downstream of the second transfer unit 20 in a direction in which the recording material is carried. The fixing unit 30 feeds the recording material, on which the toner image has been transferred by the second transfer unit 20, to a pressure area (fixing nip area) in which the fixing belt 34 and the pressing roller 32 are pressed against each other, and then causes the recording material to pass through the pressure area. This allows the toner image to be fixed on the recording material with use of heat and pressure. A surface of the recording material on which surface an unfixed toner image is formed abuts the fixing belt 34, whereas a surface of the recording material which surface is opposite from the surface on which the unfixed toner image is formed abuts the pressing roller 32. The fixing unit 30 is described below in more detail.

The internal paper feeding unit 50 stores recording materials used for image forming. The manual paper feeding unit 60 is foldably provided on a side wall of the image forming apparatus 100, and is used to manually feed a recording material. The paper output tray 80 is a tray where a recording material on which an image has been fixed is placed.

The image forming apparatus 100 has a paper carrying path for carrying (i) a recording material fed from the internal paper feeding unit 50 with use of a paper feeding roller 51*a* and (ii) a recording material fed from the manual paper feeding unit 60 with use of a paper feeding roller 61*a*, through the second transfer unit 20 and the fixing unit 30 onto the paper output tray 80. A large number of roller members for carrying a recording material are provided along the paper carrying path. The image forming apparatus 100 has a paper feeding speed (processing speed) of 220 mm/sec, and is capable of performing a continuous copying process at a copying speed of 50 sheets/min (A4 sheet; crosswise feeding).

Figure 1:
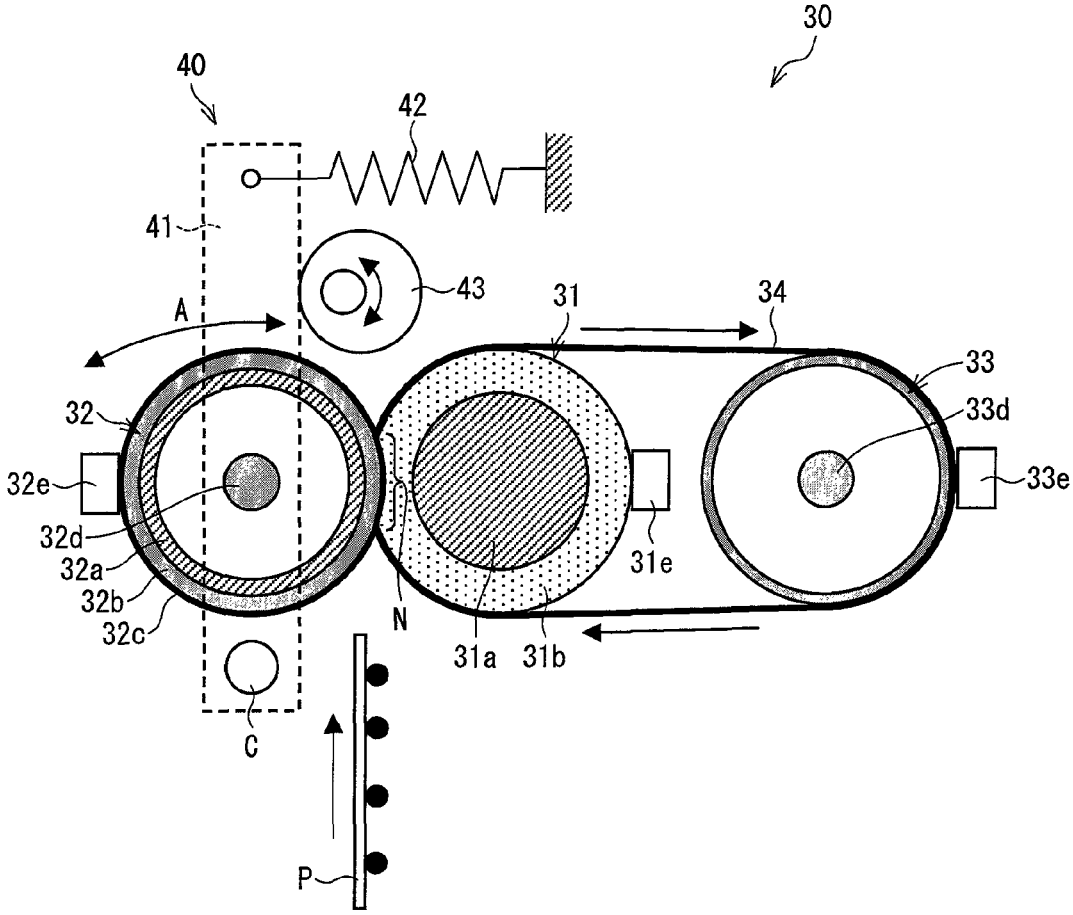
FIG. 1 is a cross-sectional view illustrating a fixing device in accordance with an embodiment of the present invention.

The following describes the fixing unit 30 in detail. FIG. 1 is a cross-sectional view illustrating an arrangement of the fixing unit 30. As illustrated in FIG. 1, the fixing unit 30 includes: a fixing roller 31; a pressing roller (pressing member) 32; a heat roller (belt holding member; first heating means) 33; a fixing belt 34; and an automatic pressure removing mechanism (disjunction mechanism) 40.

The fixing roller 31 is a roller-shaped member having a two-layer structure including: a core bar 31*a*; and an elastic layer 31*b* surrounding the core bar 31*a*. The fixing roller 31 is rotated as driven by fixing roller driving means (first driving means; see FIG. 10 mentioned below) 37 including a motor, a gear and the like. The pressing roller 32 can be pressed against the fixing roller 31 via the fixing belt 34. This forms a fixing nip area N between the fixing belt 34 and the pressing roller 32. The core bar 31*a* may be made of, e.g., (i) a metal such as iron, stainless steel, aluminum, and copper, or (ii) an alloy of two or more of them. A material of the elastic layer 31*b* is not particularly limited, provided that the material has an appropriate heat resistance and elasticity. Thus, the elastic layer 31*b* may, for example, be made of a heat-resisting rubber material such as silicon rubber, fluorine rubber, and fluoro-silicon rubber. To reduce a slipping force acting upon the fixing belt 34 (the force acting so as to shift the fixing belt 34 in a direction which is parallel to a plane of the fixing belt 34 and is perpendicular to a direction in which the fixing belt 34 is rotated), the fixing roller 31 may further include, on the elastic layer 31*b*, a surface layer (not shown) made of, e.g., (i) a fluorine-based resin material such as PFA (tetrafluoroethylene-perfluoroalkyl vinyl ether copolymer) and PTFE (polytetrafluoroethylene), or (ii) fluorine rubber. The fixing roller 31 of the present embodiment includes: a core bar 31*a* made of stainless steel and having a diameter of 20 mm; and an elastic layer 31*b* made of silicon sponge rubber and having a thickness of 5 mm, the elastic layer 31*b* coating the core bar 31*a*. The fixing roller 31 thus measures 30 mm in diameter. Further, a thermistor 31*e* for detecting temperature of an outer surface of the fixing roller 31 is provided at such a position as to face the outer surface of the fixing roller 31.

The heat roller 33 is constituted by a metal core which is made of a metal, such as aluminum and iron, having a high thermal conductivity and which has a shape of a hollow cylinder. The heat roller 33 is rotatably supported so as to be driven by the fixing belt 34 to rotate. To reduce the slipping force acting upon the fixing belt 34, the heat roller 33 may further include, on a surface of the metal core, a coating made of, e.g., fluorine resin. The heat roller 33 of the present embodiment includes: an aluminum core having a diameter of 28 mm and a thickness of 0.7 mm; and a PTFE coating which has a thickness of 20 μm and which coats the aluminum core.

The heat roller 33 contains a heater lamp (first heating means) 33*d* for heating the heat roller 33. A control section 91 (see FIG. 10) for the fixing unit 30 causes a power supply circuit section 92 (see FIG. 10) to supply electric power (i.e., to flow a current) to the heater lamp 33*d*. This causes the heater lamp 33*d* to emit light, and consequently to radiate infrared rays. An inner surface of the heat roller 33 then absorbs the infrared rays and is thus heated, whereby the entire heat roller 33 is heated.

The fixing belt 34 is held around the heat roller 33 and the fixing roller 31 under a predetermined tensile load (50 N in the present embodiment), and is driven by the fixing roller 31 to rotate. The fixing belt 34 is so heated with use of heat supplied from the heat roller 33 as to have a predetermined temperature. The fixing belt 34 thus heats a recording material on which an unfixed toner image is formed and which passes through the pressure area (fixing nip area N) between the pressing roller 32 and the fixing belt 34.

The fixing belt 34 of the present embodiment is as described in the following: The fixing belt 34 has a diameter (inner diameter) of D (mm) in a state where the fixing belt 34 is not held around the supporting members and thus has a side surface (surface at each end with respect to a width direction of the fixing belt 34) having a shape of a circle (see FIG. 4(*a*)). The fixing belt 34 has an elongation rate ER (%)=(A−D)/D×100 which satisfies $42.2 \geqq ER\ (\%) \geqq 0.1044 \times D \times \mu^{-0.5174}$, where A (mm) represents an inner diameter of the fixing belt 34, the inner diameter being observed in a state where the fixing belt 34 is held around two roller-shaped supporting members 35 and 36, each having a diameter (outer diameter) of 0.26 D (mm), so that the fixing belt 34 is under a tensile load of 0.383 (gf/mm) (see FIG. 4(*b*)), the inner diameter extending in a direction that connects respective axial centers of the two supporting members 35 and 36. The above sign p represents a coefficient of kinetic friction between the inner surface of the fixing belt 34 and the outer surface of the fixing roller 31. As is clear from experimental results described below, even in a state where the pressing roller 32 is separated from the fixing belt 34 and the fixing roller 31, the fixing belt 34, which has an elongation rate ER which falls within the above range, can be appropriately driven by the fixing roller 31 to rotate with use of only a driving force transmitted from fixing roller driving means 37 to the fixing roller 31.

Specifically, the fixing belt 34 of the present embodiment is an endless belt having a three-layer structure which includes: a substrate made of a polyimide and having a thickness of 50 μm; an elastic layer made of silicon rubber and having a thickness of 150 μm, the elastic layer being provided on the substrate; and a releasing layer made of a PFA tube and having a thickness of 30 μm, the releasing layer being provided on the elastic layer. The diameter (inner diameter) D of the fixing belt 34 is 50 mm in a state where the fixing belt 34 has a side surface having the shape of a circle.

The fixing belt 34 is simply required to have an elongation rate ER which falls within the above range. The materials of the fixing belt 34 are thus not limited to the above ones. For example, the substrate may be made of a heat-resisting resin made of, e.g., a polyimide or a polyamide-imide, or a metal material such as stainless steel and nickel. The elastic layer is simply required to be made of a material having an excellent heat resistance and elasticity. Thus, the elastic layer may, for example, be made of (i) one-component silicon rubber, two-component silicon rubber, or silicon rubber containing three or more components, (ii) LTV-type silicon rubber, RTV-type silicon rubber, or HTV-type silicon rubber, (iii) condensation-type silicon rubber or addition-type silicon rubber, (iv) fluorine rubber, or (v) fluoro-silicon rubber. The releasing layer is simply required to be made of a material having an excellent heat resistance and releasing property. Such a material may, for example, be a fluorine resin such as PTFE. The releasing layer of the present embodiment is made of a fluorine resin tube. This releasing layer has a durability better than a durability of a releasing layer formed by applying and baking a resin containing fluorine resin. To form a releasing layer with a high dimensional accuracy by applying and baking a resin, an expensive, highly precise mold is required. However, the use of the tube allows a releasing layer having a high dimensional accuracy to be obtained without the use of a mold such as the above. To reduce the coefficient of kinetic friction between the fixing belt 34 and the fixing roller 31, and thus to reduce the slipping force acting upon the fixing belt 34, the fixing belt 34 may further include fluorine resin on its inner surface, or may contain fluorine resin in the substrate.

A thermistor 33*e* for detecting a temperature of the fixing belt 34 is provided at such a position as to face an outer surface of the fixing belt 34. In addition to the thermistor 33*e*, a thermostat (not shown) for detecting an abnormal rise in the temperature of the fixing belt 34 may also be provided.

The pressing roller 32 is a roller-shaped member provided so as to be capable of being pressed against the fixing roller 31 via the fixing belt 34. The pressing roller 32 has a three-layer structure including: a core bar 32*a*; an elastic layer 32*b* outside the core bar 32*a*; and a releasing layer 32*c* outside the elastic layer 32*b*. The core bar 32*a* may, for example, be made of (i) a metal such as iron, stainless steel, aluminum, and copper, or (ii) an alloy of two or more of them. The elastic layer 32*b* may be made of, e.g., a heat-resisting rubber material such as silicon rubber and fluorine rubber. The releasing layer 32*c* may be made of a fluorine resin such as PFA and PTFE. The pressing roller 32 of the present embodiment includes: a core bar 32*a* made of iron (STKM) and having a diameter (outer diameter) of 28 mm and a thickness of 1 mm; an elastic layer 32*b* made of solid silicon rubber and having a thickness of 1 mm, the elastic layer 32*b* being provided on the core bar 32*a*; and a releasing layer 32*c* made of an electrically conductive PFA tube and having a thickness of 30 μm, the releasing layer 32*c* being provided on the elastic layer 32*b*. The pressing roller 32 thus measures approximately 30 mm in diameter.

The pressing roller 32 contains a heater lamp (second heating means) 32*d* for heating the pressing roller 32. The control section 91 (see FIG. 10) for the fixing unit 30 causes the power supply circuit section 92 (see FIG. 10) to supply electric power (i.e., to flow a current) to the heater lamp 32*d*. This causes the heater lamp 32*d* to emit light, and consequently to radiate infrared rays. An inner surface of the pressing roller 32 then absorbs the infrared rays and is thus heated, whereby the entire pressing roller 32 is heated. Further, a thermistor 32*e* for detecting a temperature of an outer surface of the pressing roller 32 is provided at such a position as to face the outer surface of the pressing roller 32.

The pressing roller 32 is connected via, e.g., the gear (not shown) to the fixing roller driving means 37 (not shown) for driving the fixing roller 31 to rotate. The pressing roller 32 is configured to be driven, by a driving force transmitted from the fixing roller driving means 37 via the gear, to rotate in a direction opposite from a direction in which the fixing roller 31 is rotated (i.e., the surface of the pressing roller 32 is moved in a direction identical to the direction in which a recording material P is carried in the fixing nip area N). In a state where the pressing roller 32 is positioned so as to be separated from the fixing belt 34 and the fixing roller 31 by the automatic pressure removing mechanism 40 described below, the connection between the pressing roller 32 and the fixing roller driving means 37 via the gear is broken. Thus, the pressing roller 32 in this state is not rotated even when the fixing roller 31 is driven to rotate. Further, the pressing roller 32 contains the heater lamp 32*d* unlike the fixing roller 31. As such, it is possible to heat the pressing roller 32 with use of the heater lamp 32*d* substantially uniformly along a circumferential direction of the pressing roller 32 even in a state where the pressing roller 32 is not being driven to rotate.

In a state where the pressing roller 32 is positioned so as to be pressed against the fixing roller 31 via the fixing belt by the automatic pressure removing mechanism 40 described below, the pressing roller 32 is pressed against the fixing roller 31 via the fixing belt 34 with use of pressing springs 42 so as to apply a predetermined load (400N in the present embodiment) to the fixing roller 31. This forms the fixing nip area N, in which the pressing roller 32 abuts the fixing belt 34. The fixing nip area N of the present embodiment has a width (nip width) of 7.5 mm in the recording material carrying direction. A recording material on which an unfixed toner image has been transferred is fed so as to pass through the fixing nip area N, so that the unfixed toner image is fixed on the recording material with use of heat and pressure.

The automatic pressure removing mechanism 40 serves to switch a position of the pressing roller 32 between the following two positions: a first position at which the pressing roller 32 is pressed by the predetermined load against the fixing roller 31 via the fixing belt 34; and a second position at which the pressing roller 32 is separated from the fixing roller and the fixing belt 34. As illustrated in FIG. 1, the automatic pressure removing mechanism 40 includes: pressing levers 41; pressing springs (urging means) 42; an eccentric cam 43; and a rotary shaft C. A pair of (i) one of the pressing levers 41 and (ii) one of the pressing springs 42 is provided on each side of the pressing roller 32. The rotary shaft C is positioned so as to penetrate both of the pressing levers 41 provided on the respective sides of the pressing roller 32. The eccentric cam 43 is provided so as to abut both of the pressing levers 41 provided on the respective sides of the pressing roller 32. The automatic pressure removing mechanism 40 may instead include eccentric cams 43 respectively abutting the pressing levers 41 provided on the respective sides of the pressing roller 32.

The pressing roller 32 has a rotary shaft rotatably attached to the pressing levers 41. Each of the pressing levers 41 has one end rotatably supported by the rotary shaft C and the other end urged by a corresponding one of the pressing springs 42 in a direction of the fixing roller 31. The eccentric cam 43 is provided so as to abut a surface of each of the pressing levers 41 which surface faces the fixing roller 31. With this arrangement, when the control section 91 (see FIG. 10) controls an operation of driving means (not shown) including, e.g., a motor for driving the eccentric cam 43 to rotate, the eccentric cam 43 is rotated, so that a position at which the eccentric cam 43 abuts each of the pressing levers 41 is changed. This causes the pressing levers 41 to move in a direction indicated by an arrow A in FIG. 1, and consequently switches the position of the pressing roller 32 between the first position and the second position.

The control section 91 controls an operation of each section of the fixing unit 30. The control section 91 may be included in a main control section of the image forming apparatus 100, or may be so provided as a member separate from the main control section as to operate in collaboration with the main control section.

Figure 10:
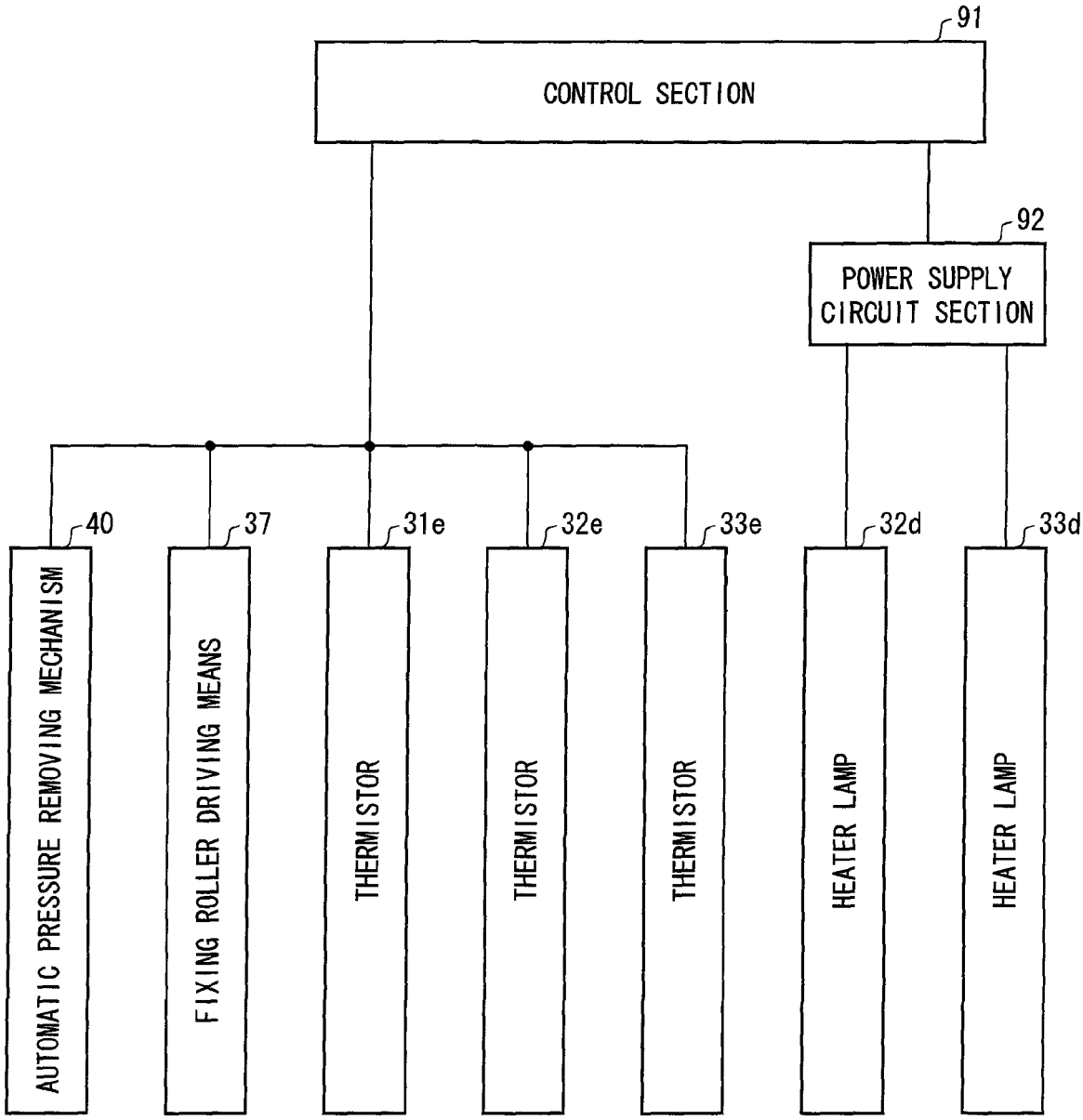
FIG. 10 is a block diagram illustrating how the fixing device illustrated in FIG. 1 is configured to be controlled.

FIG. 10 is a block diagram illustrating a relationship between the control section 91 and each section of the fixing unit 30. As illustrated in FIG. 10, the control section 91 is connected to: the automatic pressure removing mechanism 40 (specifically, the driving means for driving the eccentric cam 43 included in the automatic pressure removing mechanism 40); the fixing roller driving means 37; the thermistors 31*e*, 32*e*, and 33*e*; and the power supply circuit section 92. The power supply circuit section 92 is further connected to the heater lamps 32*d* and 33*d*.

On the basis of results of detecting the temperatures of the respective sections, the results being supplied from the thermistors 31*e*, 32*e*, and 33*e*, the control section 91 having the above arrangement controls the electric power supplied from the power supply circuit section 92 to the heater lamps 32*d* and 33*d*. The control section 91 thus performs a control so that the respective temperatures of the fixing belt 34 and the pressing roller 32 will be equal to their corresponding set temperatures. The control section 91 controls the operation of the driving means for the eccentric cam 43 of the automatic pressure removing mechanism 40 so as to switch the position of the pressing roller 32 between the first position and the second position. Further, the control section 91 controls the operation of the fixing roller driving means 37 so as to control how the fixing roller 31 is rotated.

FIG. 9 is a table explaining how each section of the fixing unit 30 is controlled. As illustrated in FIG. 9, the fixing unit 30 has a warm-up mode, a paper carrying mode, and a standby mode.

The warm-up mode is a processing mode in which the fixing belt 34 is heated after the image forming apparatus 100 is turned ON and until the temperature of the fixing belt 34 reaches a predetermined warm-up completion temperature which is set so that the fixing belt 34 can start its fixing process rapidly. As illustrated in FIG. 9, in the warm-up mode, the automatic pressure removing mechanism 40 is turned ON so as to separate the pressing roller 32 from the fixing belt 34 and the fixing roller 31, while the fixing roller driving means 37 is also turned ON so as to drive the fixing roller 31 to rotate. Further, an amount of the electric power supplied to each of the heater lamps 32*d* and 33*d* is controlled so that the respective temperatures of the fixing belt 34 and the pressing roller 32 reach their corresponding target temperatures (warm-up completion temperatures). When the respective temperatures of the fixing belt 34 and the pressing roller 32 reach their corresponding target temperatures, the warm-up ends.

The paper carrying mode is a processing mode in which a recording material on which an unfixed toner image is formed is carried through the fixing nip area N between the fixing belt 34 and the pressing roller 32 so as to perform the fixing process. As illustrated in FIG. 9, in the paper carrying mode, the automatic pressure removing mechanism 40 is turned OFF so as to press the pressing roller 32 against the fixing roller 31 via the fixing belt 34, while the fixing roller driving means 37 is turned ON so as to drive the fixing roller 31 and the pressing roller 32 to rotate. Further, the amount of the electric power supplied to each of the heater lamps 32*d* and 33*d* is controlled so as to maintain the respective temperatures of the fixing belt 34 and the pressing roller 32 at their corresponding target temperatures (fixing temperatures). In this state, the recording material on which the unfixed toner image is formed is carried through the fixing nip area N.

The standby mode is a mode in which the respective temperatures of the fixing belt 34 and the pressing roller 32 are maintained within their corresponding predetermined temperature ranges (standby temperature ranges) in a case where a predetermined period has elapsed while no subsequent instruction is given to set the fixing unit 30 to the paper carrying mode after the warm-up mode or the paper carrying mode ends. In the standby mode, the automatic pressure removing mechanism 40 is turned ON so as to separate the pressing roller 32 from the fixing belt 34 and the fixing roller 31, while the fixing roller driving means 37 is turned ON so as to drive the fixing roller 31 to rotate. The amount of the electric power supplied to each of the heater lamps 32*d* and 33*d* is controlled so as to maintain the respective temperatures of the fixing belt 34 and the pressing roller 32 at their corresponding target temperatures (standby temperatures). Further, the result of detecting the temperature of the fixing roller 31 by the thermistor 31*e* is monitored so that the fixing roller 31 continues being driven to rotate in a case where the temperature of the fixing roller 31 is lower than its control target temperature (standby temperature). When the temperature of the fixing roller 31 reaches the control target temperature (standby temperature), the fixing roller 31 stops being driven to rotate.

The following describes results of an experiment conducted to find conditions under which, even in the state where the pressing roller 32 is separated from the fixing belt 34 and the fixing roller 31, the fixing belt 34 is driven by the fixing roller 31 to rotate with use of only the driving force transmitted from the fixing roller driving means 37 to the fixing roller 31. FIG. 3 is a table showing (i) various arrangements of the fixing belt 34 used in the experiment and (ii) the experimental results. As shown in FIG. 3, the experiment examined whether the fixing belt 34 would be appropriately driven by the fixing roller 31 to rotate. The fixing belt 34 had 18 kinds which differ in (i) the layer structure (6 kinds), (ii) the diameter D (3 kinds), and (iii) the width (2 kinds) in the direction perpendicular to the direction in which the fixing belt 34 is rotated. The fixing roller 31 had 3 kinds which differ in the coefficient μ of kinetic friction with respect to the inner surface (in the present embodiment, a polyimide of which the substrate is made) of the fixing belt 34.

Figure 4:
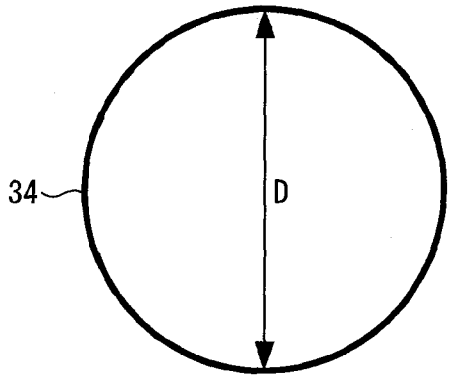
FIG. 4(*a*) is a view explaining how an elongation rate ER (%) of the fixing belt is defined.
Figure 4:
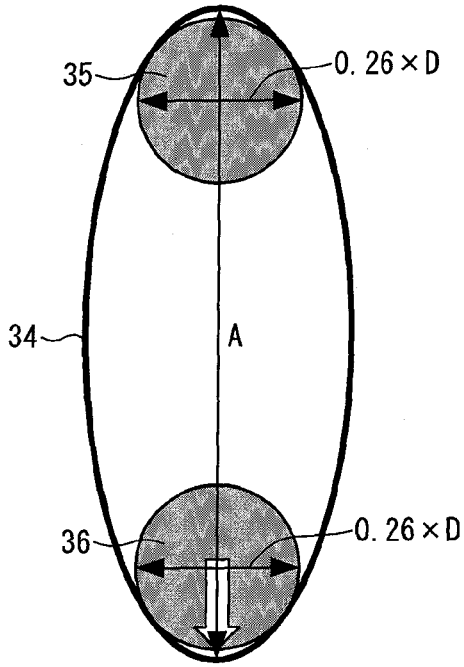

As illustrated in FIG. 4(*a*), the diameter D (mm) measured was a diameter (inner diameter) observed in a state where the fixing belt 34 was not held around supporting rollers, and thus had a side surface having a shape of a circle. The width of the fixing belt 34 was a width (i) extending in the direction perpendicular to the rotation direction of the fixing belt 34, and (ii) observed in the state where the fixing belt 34 was not held around supporting rollers, i.e., in a state where no tensile tension was acting upon the fixing belt 34.

As illustrated in FIG. 4(*b*), a longitudinal diameter A (mm) of the fixing belt 34 under load was measured as follows: An upper end of the fixing belt 34 was supported by inserting through the fixing belt 34 a roller-shaped supporting member 35 having a diameter (0.26×D (mm) in this experiment) which was sufficiently smaller than the diameter of the fixing belt 34. Further, a roller-shaped spindle 36 having a diameter (0.26×D (mm) in this experiment) which was also sufficiently smaller than the diameter of the fixing belt 34 was inserted through the fixing belt 34 at a lower end. A predetermined tensile load (0.383 gf per unit length (1 mm) in this experiment) was thus applied over the entire width of the fixing belt 34. An inner diameter of the fixing belt 34 under the predetermined tensile load was measured as the longitudinal diameter A (mm), the inner diameter extending in a direction that connects respective axial centers of the supporting member 35 and the spindle 36. The tensile load per unit length was calculated by dividing (i) the tensile load acting upon the fixing belt 34 by (ii) the entire width (width in the direction perpendicular to the rotation direction) of the fixing belt 34 observed in the state where no tensile load was acting thereupon.

The elongation rate ER (%) was calculated in accordance with the equation $ER=(A-D)/D\times100$. A higher elongation rate ER indicates a smaller rigidity (i.e., greater flexibility) for a fixing belt having a given diameter (inner diameter).

FIG. 5 is a table showing respective arrangements of the three kinds of the fixing roller 31 used in this experiment. The coefficient μ of kinetic friction of each kind for the fixing roller 31 with respect to the polyimide included in the inner surface of the fixing belt 34 was measured by Euler belt method.

The experiment verified a capability of the fixing belt 34 to be driven to rotate as follows: The fixing belt 34 and the fixing roller 31 were mounted in the fixing unit 30. The fixing roller 31 was driven to rotate with use of the driving force from the fixing roller driving means 37 while the pressing roller 32 was separated from the fixing belt 34 and the fixing roller 31. Whether the fixing belt 34 was driven by the fixing roller 31 to rotate was then visually observed. In FIG. 3, the symbol G indicates that the fixing belt 34 was driven to rotate normally, whereas the symbol P indicates that the fixing belt 34 was not driven to rotate. A distance between respective axes of the fixing roller 31 and the heat roller 33 was adjusted so that the tensile load acting upon the fixing belt 34 was constantly 50 N regardless of the diameter of the fixing belt 34 in use.

Figure 6:
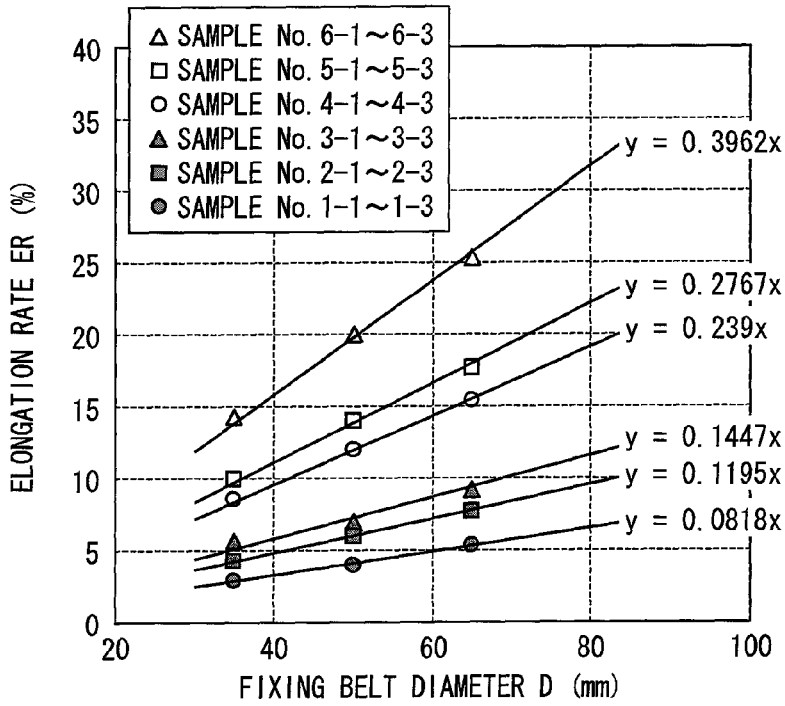
FIG. 6 is a graph showing results of the experiment, the table showing a relationship between the diameter D and the elongation rate ER for each kind of the fixing belt used in the experiment.

It is clear from the experimental results shown in FIG. 3 that whether the fixing belt 34 is capable of being driven by the fixing roller 31 to rotate depends on (i) flexibility of the fixing belt 34 and (ii) the coefficient μ of kinetic friction between the fixing belt 34 and the fixing roller 31. Specifically, for any fixing belt 34 having a given diameter (inner diameter) and a given coefficient μ of kinetic friction, a higher elongation rate ER of the fixing belt 34 translates into a higher likelihood of the fixing belt 34 being driven to rotate. Further, for a given fixing belt 34, a larger coefficient μ of kinetic friction translates into a higher likelihood of the fixing belt 34 being driven to rotate. FIG. 6 is a graph illustrating a relationship between the diameter D and the elongation rate ER of each of the 18 kinds of the fixing belt 34. It is clear from FIG. 6 that the diameter D and the elongation rate ER are proportional to each other for fixing belts 34 having any given one of the layer structures, and thus can be approximated in accordance with the linear equations shown in FIG. 6. In other words, ER/D is constant for fixing belts 34 having any given layer structure. For example, ER/D=0.0818 for samples No. 1-1 to 1-3, and ER/D=0.3962 for samples No. 6-1 to 6-3.

The following describes a relationship between (i) a coefficient μ of kinetic friction and (ii) a minimum value of ER/D which allows the fixing belt 34 to be driven to rotate under a condition of the above coefficient μ of kinetic friction. As illustrated in FIG. 3, in a case where, for example, the coefficient μ of kinetic friction is 0.2, ER=8.6 is the minimum value of ER under which the fixing belt 34 is driven to rotate. Since ER/D in the case of ER=8.6 is 0.239, the fixing belt 34 is in this case driven to rotate under a condition of ER/D>0.239. Similarly, in a case of μ=0.55, the minimum value of ER under which the fixing belt 34 is driven to rotate is ER=5.7. The fixing belt 34 in this case can thus be driven to rotate under a condition of ER/D>0.1447. Further, in a case of μ=0.75, the minimum value of ER under which the fixing belt 34 is driven to rotate is ER=4.3. The fixing belt 34 in this case can thus be driven to rotate under a condition of ER/D>0.1195.

Figure 7:
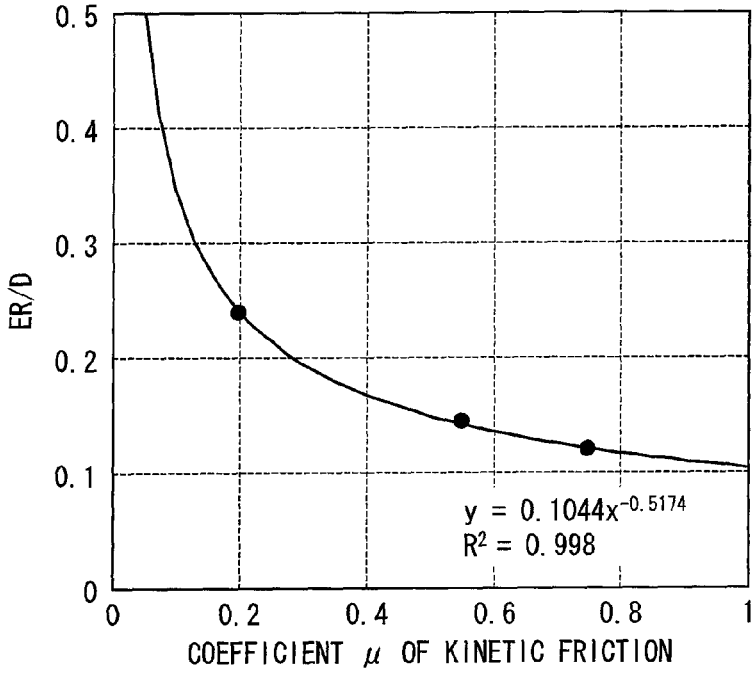
FIG. 7 is a graph showing results of the experiment, the table showing a relationship between the coefficient μ of kinetic friction and the ER/D for each kind of the fixing belt used in the experiment.

FIG. 7 is a graph illustrating a relationship between (i) the coefficient μ of kinetic friction and (ii) the minimum value of ER/D under which the fixing belt 34 is driven to rotate. As is clear from FIG. 7, the relationship between the two can be approximated in accordance with the following Formula (I):

$$ER/D=0.1044\times\mu^{-0.5174} \quad (1).$$

Further, according to Formula (1), $$ER=0.1044\times D\times\mu^{-0.5174} \quad (2)$$

Hence, it is clear that the fixing belt 34 is driven to rotate in a case where the coefficient μ of kinetic friction, the diameter D (mm) of the fixing belt 34, and the elongation rate ER of the fixing belt 34 satisfy the following Formula (3):

$$ER\geqq 0.1044\times D\times\mu^{-0.5174} \quad (3).$$

The elongation rate ER of the fixing belt 34 has its maximum value obtained in a case where the fixing belt 34 is stretched to the full extent as illustrated in FIG. 8.

The diameter D and the longitudinal diameter A of the fixing belt 34 in the state illustrated in FIG. 8 has a relationship represented by the following Formula (4):

$$2\times(A-0.26\times D)+0.26\pi D=\pi D \quad (4).$$

The longitudinal diameter A in this state is hence represented by the following Formula (5):

$$A=(0.37\pi+0.26)D \quad (5).$$

Hence, the elongation rate ER of the fixing belt 34 for appropriately driving the fixing belt 34 to rotate has a maximum value of 42.2% as shown in the following:

$$\begin{aligned} ER &= (A-D)/D\times 100 \\ &= (0.37\pi+0.26-1)\times 100 \\ &= 42.2. \end{aligned}$$

Therefore, even in the case where only the fixing roller 13 is driven to rotate while the pressing roller 32 is separated from the fixing belt 34 and the fixing roller 31, the fixing belt 34 is driven by the fixing roller 31 to rotate if the elongation rate ER (%) satisfies the following Formula (6):

$$42.2\geqq ER\geqq 0.1044\times D\times\mu^{-0.5174} \quad (6).$$

As described above, the fixing unit 30 of the present embodiment is a fixing unit using the belt fixing method, the fixing unit including: the fixing roller 31; the heat roller 33 for heating the fixing belt 34; the fixing belt 34 held around the fixing roller 31 and the heat roller 33; the pressing roller 32 positioned so as to face the fixing roller 31 via the fixing belt 34; the heater lamp 32*d* for heating the pressing roller 32; and the automatic pressure removing mechanism 40 which switches the position of the pressing roller 32 between (i) the position at which the pressing roller 32 is pressed against the fixing roller 31 via the fixing belt 34 and (ii) the position at which the pressing roller 32 is separated from the fixing belt 34. The fixing unit 30 is configured such that in the warm-up mode and the standby mode, (i) the pressing roller 32 is separated from the fixing belt 34, (ii) the fixing belt 34 is heated by the heat roller 33, and (iii) the fixing roller 31 is driven to rotate. The fixing belt 34 included in the fixing unit 30 is a belt which satisfies Formula (6).

As described above, in the warm-up mode and the standby mode, the pressing roller 32 is separated from the fixing roller 31 and the fixing belt 34 so as to remove the pressure applied from the pressing roller 32 to the fixing belt 34 and the fixing roller 31. This prevents the fixing belt 34 from being damaged due to the pressure acting thereupon from the pressing roller 32, and in turn allows the fixing belt 34 to have a longer life.

The fixing belt 34, which satisfies Formula (6), can be driven by the fixing roller 31 to rotate even in the state where the pressing roller 32 is separated from the fixing belt 34. This allows the fixing roller 31 to be uniformly heated with use of heat transferred from the heat roller 33 to the fixing belt 34. The respective temperatures of the fixing belt 34 and the pressing roller 32 can thus be controlled independently. This allows a fixing property to be constantly stable during the fixing process performed immediately after a warm-up or the standby mode.

In the present embodiment, the result of detecting the temperature of the fixing roller 31 is monitored in the standby mode. In the case where the temperature of the fixing roller 31 is lower than the target temperature, the fixing roller 31 is driven to rotate. When the temperature of the fixing roller 31 then reaches the target temperature, the fixing roller 31 stops being driven to rotate. This allows the fixing roller 31 in the standby mode to be controlled so as to optimize a condition under which the fixing roller 31 is preheated, and thus allows the fixing property to be further stabilized.

In the present embodiment, when the pressing roller 32 is pressed against the fixing belt 34 in the paper carrying mode, the pressing roller 32 is driven to rotate with use of the driving force transmitted from the fixing roller driving means 37 via, e.g., the gear. If the fixing belt 34, the heat roller 33, and the pressing roller 32 were driven only by the fixing roller 31 to rotate, the fixing roller 31 would be under an extremely heavy load. Since the fixing roller 31 includes the elastic layer 31*b* and a coating layer 31*c*, each of which has a relatively low durability, a heavy load acting upon the fixing roller 31 likely breaks these layers. In view of this, the pressing roller 32 of the present embodiment is, as described above, rotated as driven not by the fixing roller 31 and the fixing belt 34, but with use of the driving force from the fixing roller driving means 37. This reduces the load acting upon the fixing roller 31, and thus allows the fixing roller 31 to have a longer life.

In the present embodiment, the pressing roller 32 is driven to rotate with use of the driving force from the fixing roller driving means 37. Each of the fixing roller 31 and the pressing roller 32 is thus supplied with a driving force from common driving means. This simplifies the arrangement of the fixing unit 30, thus reducing the production cost and downsizing the fixing unit 30. The above arrangement also makes it possible to easily rotate the fixing roller 31, the fixing belt 34, and the pressing roller 32 at a synchronous speed (at which respective surfaces of these sections move in the fixing nip area N). However, the present invention is not necessarily limited to the above arrangement in which the fixing roller 31 and the pressing roller 32 have common driving means. Thus, a separate driving source (second driving means) for driving the pressing roller 32 may be provided in addition to the fixing roller driving means (first driving means) 37.

The heat roller 33 of the present embodiment contains a single heater lamp 33*d*. However, the number of the heater lamp 33*d* is not limited to this. The heat roller 33 may thus contain a plurality of heater lamps 33*d*.

According to the present embodiment, heating means for heating the fixing belt 34 is contained in the heat roller 33. However, the arrangement of the heating means is not limited to this. The fixing belt 34 may, for example, be rotatably held around the fixing roller 31 and a supporting roller containing no heating means so that the fixing belt 34 is heated by heating means provided separately from the supporting roller. The heating means may be contact type heating means which abuts the fixing belt 34, or may be non-contact type heating means which does not abut the fixing belt 34. The heating means may instead be an induction heating device using induction heating. Alternatively, the heating means may be formed by appropriately combining a plurality of kinds of heating means. Further alternatively, the heating means (heater) itself may function as the belt holding member for rotatably holding the fixing belt 34.

In the present embodiment, the fixing belt 34 is held around two roller members (i.e., the fixing roller 31 and the heat roller 33). However, the arrangement is not limited to this. Thus, the fixing belt 34 may be held around three or more roller members. Further, the fixing belt 34 is not necessarily held around a plurality of roller members. The fixing belt 34 is simply required to be held so as to be capable of being driven by the fixing roller 31 to rotate.

[Embodiment 2]

Another embodiment of the present invention is described below. For convenience of explanation, members in the present embodiment that are functionally equivalent to their corresponding members described in Embodiment 1 are assigned the same reference numerals, and a description of such members is thus omitted.

Figure 11:
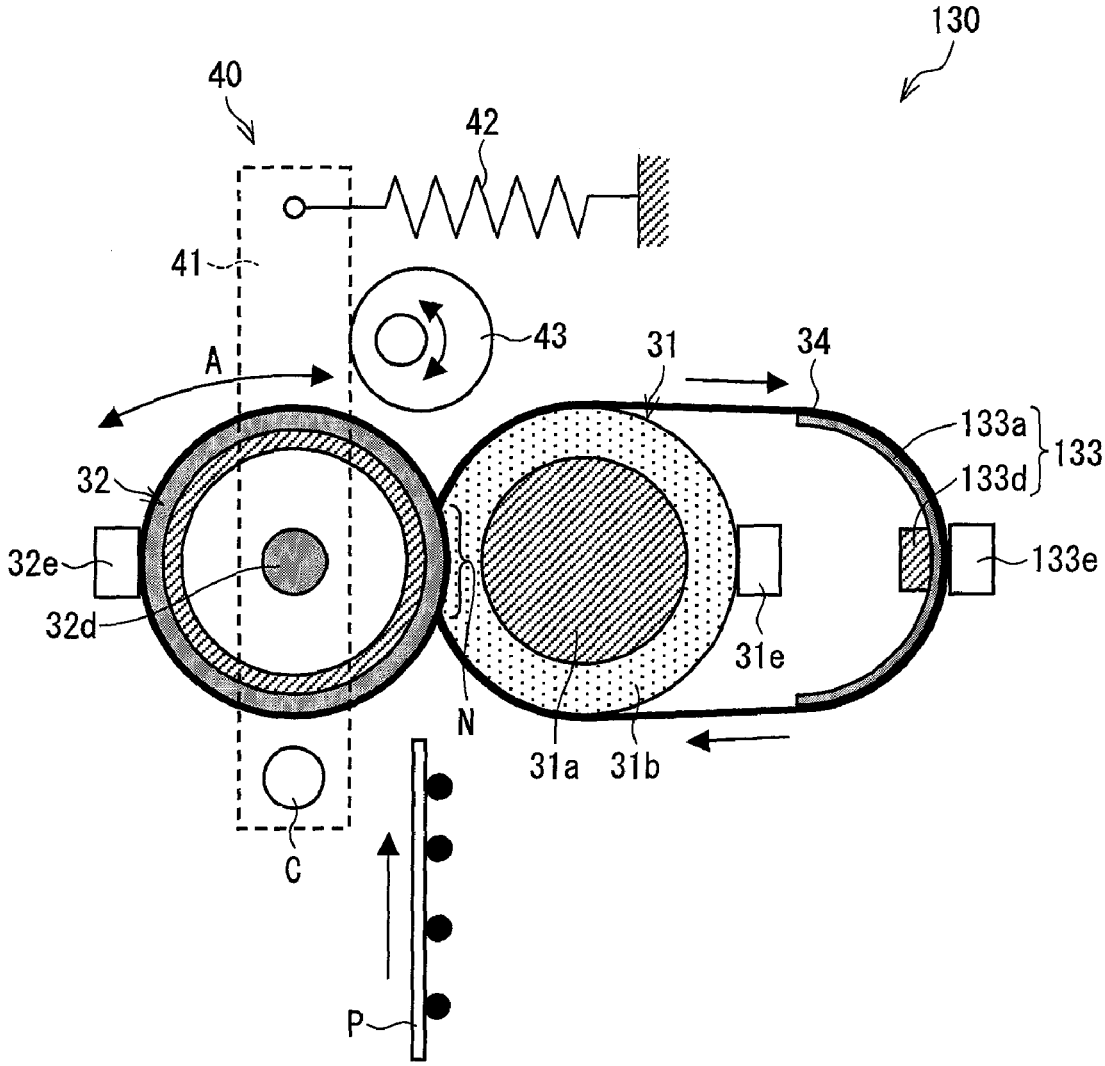
FIG. 11 is a cross-sectional view illustrating a fixing device in accordance with another embodiment of the present invention.

FIG. 11 is a cross-sectional view illustrating an arrangement of a fixing unit (fixing device) 130 according to the present embodiment. The fixing unit 130 is intended to replace the fixing unit 30 included in the image forming apparatus 100 described in Embodiment 1.

As illustrated in FIG. 11, the fixing unit 130 includes a plate-shaped heating member (belt holding member; first heating means) 133 to replace the heat roller 33 and the heater lamp 33*d* included in the fixing unit 30 of Embodiment 1. The plate-shaped heating member 133 serves to (i) support the fixing belt 34 so that the fixing belt 34 is rotatable and to (ii) heat the fixing belt 34 so that the fixing belt 34 has a predetermined temperature. The other parts of the fixing unit 130 are substantially identical to their corresponding parts of the fixing unit 30 of Embodiment 1.

Figure 12:
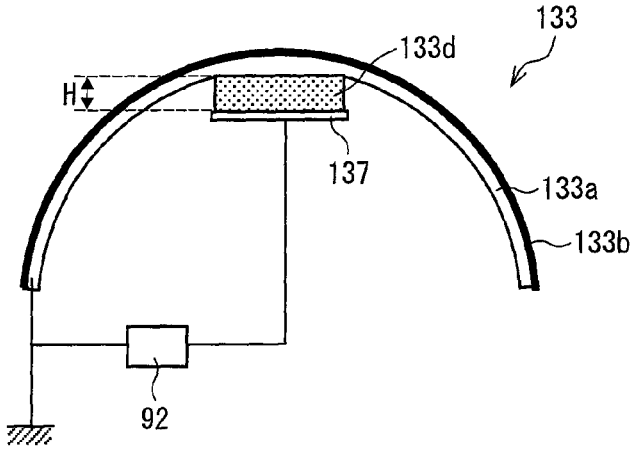
FIG. 12 is a cross-sectional view schematically illustrating an arrangement of a plate-shaped heating member and included in the fixing device illustrated in FIG. 11.
Figure 13:
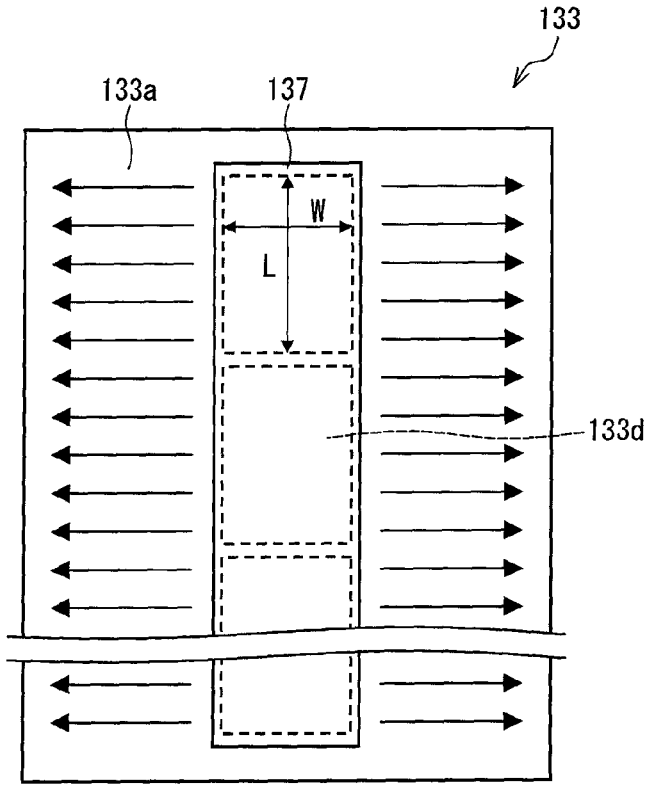
FIG. 13 is a plan view illustrating the plate-shaped heating member and included in the fixing device illustrated in FIG. 11.

As illustrated in FIG. 11, the plate-shaped heating member 133 includes: a heat diffusing member (belt holding member; plate-shaped member) 133*a*; and PTC (positive temperature coefficient) ceramic heaters (first heating means; plate-shaped heater) 133*d*. FIG. 12 is a cross-sectional view of the plate-shaped heating member 133. FIG. 13 is a plan view of the plate-shaped heating member 133.

The heat diffusing member 133*a* has an abutting surface (belt supporting surface) which abuts the fixing belt 34. The abutting surface has a shape which is curved in a semicircular arc along the circumferential direction of the fixing belt 34. The heat diffusing member 133*a* of the present embodiment is prepared by (i) axially cutting a pipe which is made of aluminum alloy and which has a diameter of 28 mm and a thickness of 1 mm, and (ii) providing an insulating coat layer (in the present embodiment, a PTFE coat layer having a thickness of 20 μm) 133*b* on an outer surface of the pipe. The heat diffusing member 133*a* is in contact with the fixing belt 34 across a width (heating nip width) of 44 mm along the arc. The material of the heat diffusing member 133*a* is not limited to the above one. The heat diffusing member 133*a* may be made of any material that can transfer heat from the PTC ceramic heaters 133*d* to the fixing belt 34. However, as described below, the heat diffusing member 133*a* is preferably made of a material which allows the heat from the PTC ceramic heaters 133*d* to be efficiently diffused in the heat diffusing member 133*a* along the circumferential direction of the fixing belt 34. This improves efficiency in heating the fixing belt 34.

The PTC ceramic heaters 133*d* are each a ceramic heater made of barium titanate. The PTC ceramic heaters 133*d* each have the following property: In a case where its temperature rises above a certain level, its resistance value changes drastically. The PTC ceramic heaters 133*d* of the present embodiment have a resistance value which increases at 220° C. or above.

Each of the PTC ceramic heaters 133*d* measures: 12.3 mm in width W along the circumferential direction of the fixing belt 34; 30 mm in length L along the width direction of the fixing belt 34; and 2.1 mm in height H. The PTC ceramic heaters 133*d* are arranged multiply (according to the present embodiment, in a number of 10) in a side-by-side relationship with one another along a longitudinal direction (width direction of the fixing belt 34) of the fixing unit 130. The PTC ceramic heaters 133*d* are adhered to an inner surface of the heat diffusing member 133*a* with use of a silicon-based adhesive (electrically conductive adhesive).

As illustrated in FIG. 12, each of the PTC ceramic heaters 133*d* is provided with an electricity feeding electrode 137 formed with a plate-shaped member made of aluminum. The electricity feeding electrode 137 is attached, with use of a silicon-based adhesive (electrically conductive adhesive), to a surface of the PTC ceramic heater 133*d*, the surface being located opposite from a surface which is adhered to the heat diffusing member 133*a*. The electricity feeding electrode 137 is connected to the power supply circuit section 92. This allows the control section 91 to control electric power supplied from the power supply circuit section 92 to each PTC ceramic heater 133*d*. The control section 91 thus controls an amount of heat generated by each PTC ceramic heater 133*d*.

The PTC ceramic heaters 133*d* each have an electric resistance of 100Ω, and thus in total have an electric resistance of 10Ω (parallel circuit). Applying a voltage of AC 100 V from the power supply circuit section 92 causes the PTC ceramic heaters 133*d* to generate a thermal energy of approximately 1000 W in total.

The thermal energy generated by the PTC ceramic heaters 133*d* is diffused in the heat diffusing member 133*a* along directions indicated by arrows shown in FIG. 13. This causes the heat to be transferred over a wide area of the fixing belt 34, as compared to a case in which the fixing belt 34 is heated directly by the PTC ceramic heaters 133*d*. Consequently, it is possible to improve performance in heating the fixing belt 34. This further allows the fixing belt 34 to be appropriately heated even in a case where the fixing belt 34 is rotated at a high speed due to a high processing speed.

As described above, an advantageous effect substantially identical to that achieved in Embodiment 1 can be achieved even with the arrangement in which the plate-shaped heating member 133 is provided instead of the heat roller 33 and the heater lamp 33*d* described in Embodiment 1.

The present embodiment describes a case in which PTC ceramic heaters are used as heaters. The heating means for heating the fixing belt 34 is, however, not limited to this. The heating means may, for example, be (i) ceramic heaters lacking the PTC property and each having an arrangement in which a resistive heater such as a silver-palladium alloy is printed on an insulating ceramic substrate, or (ii) polyimide heaters each having an arrangement in which a resistive heater such as stainless steel is formed by etching on an insulating sheet made of, e.g., a polyimide.

[Embodiment 3]

Still another embodiment of the present invention is described below. For convenience of explanation, members in the present embodiment that are functionally equivalent to their corresponding members described in the above embodiments are assigned the same reference numerals, and a description of such members is thus omitted.

Embodiments 1 and 2 describe an arrangement in which the fixing unit includes a single belt member. The present embodiment, in contrast, describes an example arrangement in which the fixing unit includes a plurality of belt members.

Figure 14:
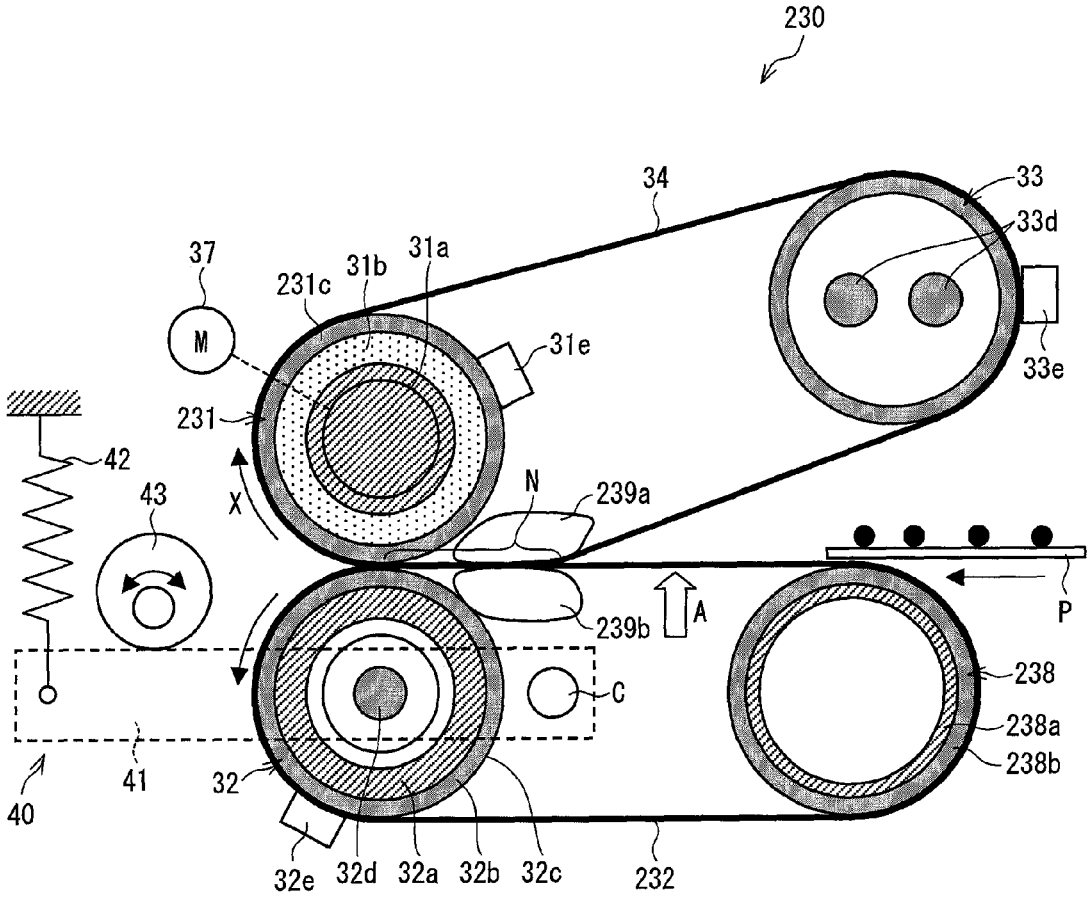
FIG. 14 is a cross-sectional view illustrating a fixing device in accordance with still another embodiment of the present invention.

FIG. 14 is a cross-sectional view illustrating a fixing unit (fixing device) 230 according to the present embodiment. As illustrated in FIG. 14, the fixing unit 230 includes: a fixing roller 31; a heat roller 33; a fixing pad 239*a*; a fixing belt 34; a pressing roller 32; a tension roller (second belt holding member) 238; a pressing pad 239*b*; a pressing belt 232; and an automatic pressure removing mechanism (disjunction mechanism) 40. In other words, the fixing unit 230 is of a twin belt system including the fixing belt 34 and the pressing belt 232.

Respective arrangements of the fixing roller 31, the heat roller 33, and the fixing belt 34 of the present embodiment are substantially identical to those described in Embodiment 1. According to the present embodiment, however, the fixing belt 34 is held around not only the fixing roller 31 and the heat roller 33, but also the fixing pad 239*a*. The fixing pad 239*a* is made of polyphenylene sulfide (PPS) resin. Each end of the fixing pad 239*a* is supported by a side plate (not shown) of the fixing unit 230. Respective positions of the fixing roller 31, the heat roller 33, and the fixing pad 239*a* are adjusted so that the fixing belt 34 is under a tensile load of 50 N when held.

The fixing roller 31 is configured to be pressed by a predetermined load against the pressing roller 32 (described below) via the fixing belt 34 and the pressing belt 232 in the paper carrying mode. The fixing pad 239*a* is configured to be pressed by a predetermined load against the pressing pad 239*b* (described below) via the fixing belt 34 and the pressing belt 232 in the paper carrying mode. This makes it possible to fuse toner of an unfixed toner image on a recording material P carried through between the fixing belt 34 and the pressing belt 232, and consequently to fix the unfixed toner image on the recording material P. According to the example illustrated in FIG. 14, the heat roller 33 contains two heater lamps 33*d*. However, the number of the heater lamps is not limited to this. The heat roller 33 may thus contain a single heater lamp, or three or more heater lamps.

The pressing belt 232 is rotatably held around the pressing roller 32, the tension roller 238, and the pressing pad 239*b*, and is configured to be driven by the pressing roller 32 to rotate. The pressing belt 232 may have an arrangement similar to that of the fixing belt 34. In the present embodiment, respective positions of the pressing roller 32, the tension roller 238, and the pressing pad 239*b* are adjusted so that the pressing belt 232 is under a tensile load of 50 N held around the pressing roller 32, the tension roller 238, and the pressing pad 239*b*. Respective arrangements of the pressing roller 32 and the automatic pressure removing mechanism 40 of the present embodiment are substantially identical to those described in Embodiment 1.

The tension roller 238 is a roller-shaped member including a core bar 238*a* and an elastic layer 238*b*. The tension roller 238 is supported by the side plates (not shown) of the fixing unit 230 so as to be rotatable about an axis. The tension roller 238 of the present embodiment includes: a core bar 238*a* made of iron alloy and having an outer diameter of 30 mm and an inner diameter of 26 mm; and an elastic layer 238*b* on a surface of the core bar 238*a*, the elastic layer 238*b* being made of silicon sponge so as to lower thermal conductivity, and consequently to reduce heat conducted from the pressing belt 232.

As described above, the pressing pad 239*b* is provided at such a position as to face the fixing pad 239*a* via the fixing belt 34 and the pressing belt 232. The pressing pad 239*b* is made of PPS resin. Each end of the pressing pad 239*b* is attached to one of the pressing levers 41, which are included in the automatic pressure removing mechanism 40 and which are provided on respective sides of the pressing roller 32. This allows the pressing roller 32, the pressing pad 239*b*, and the pressing belt 232 to be separated from the fixing belt 34 in a case where the eccentric cam 43 is operated so as to move the pressing roller 32 in such a direction as to separate the pressing roller 32 from the fixing roller 31 and the fixing belt 34. The control section 91 controls each section of the fixing unit 230 in a manner identical to that described in Embodiment 1.

As described above, the fixing device of the twin belt system including the fixing belt 34 and the pressing belt 232 also achieves an advantageous effect substantially identical to that described in Embodiment 1.

To obtain a large fixing nip area N without increasing a size of the fixing unit 230, the present embodiment includes the fixing pad 239*a* and the pressing pad 239*b* so that the two pads face each other via the fixing belt 34 and the pressing belt 232. The two pads are thus configured to be pressed against each other by a predetermined load via the fixing belt 34 and the pressing belt 232 in the paper carrying mode. This forms a large fixing nip area N which extends from (i) a position at which the fixing pad 239*a* faces the pressing pad 239*b* to (ii) a position at which the fixing roller 31 faces the pressing roller 32. This in turn increases an area in which heat is transferred to a recording material P. As a result, even in the case where the processing speed is high, it is possible to prevent defective fixing from occurring due to an insufficient amount of heat transferred to the recording material P.

In the case where non-rotary members such as the fixing pad 239*a* and the pressing pad 239*b* are provided as in the present embodiment, respective inner surfaces of the fixing belt 34 and the pressing belt 232 are rubbed by the fixing pad 239*a* and the pressing pad 239*b*, respectively. Thus, either in a case where a coefficient of kinetic friction between the fixing belt 34 and the fixing pad 239*a* is large, or in a case where a coefficient of kinetic friction between the pressing belt 232 and the pressing pad 239*b* is large, resistance to the sliding is large. This may cause such problems as an abraded belt, a damaged gear, and/or increased power consumed by the fixing roller driving means 37. To prevent such problems, each of the fixing pad 239*a* and the pressing pad 239*b* is preferably made of a material having a small coefficient of kinetic friction with respect to a corresponding one of the fixing belt 34 and the pressing belt 232. Alternatively, each of the fixing pad 239*a* and the pressing pad 239*b* is preferably provided, on a surface facing a corresponding one of the fixing belt 34 and the pressing belt 232, with a low-friction sheet (not shown) having a small coefficient of kinetic friction.

The present embodiment describes an arrangement in which the fixing pad 239*a* and the pressing pad 239*b* are provided. However, the two pads are not necessarily required, and may thus be omitted. In this case, the fixing nip area N may be formed only at the position where the fixing roller 31 faces the pressing roller 32. Alternatively, a portion of the pressing belt 232 which portion is not in contact with the pressing roller 32 or the tension roller 238 may be pressed against the fixing roller 31 via the fixing belt 34.

According to the above embodiments, the control section 91 included in each of the fixing units 30, 130, and 230 (or in the image forming apparatus 100) is realized by software with use of a processor such as a CPU (central processing unit). Specifically, the control section 91 includes a CPU which executes instructions in control programs realizing the functions, a ROM (read only memory) which stores the above programs, a RAM (random access memory) onto which the programs are loaded, a storage device (a recording medium) such as a memory in which the programs and data of various kinds are stored, and the like. The object of the present invention is achieved by mounting to the fixing units 30, 130, and 230 (or to the image forming apparatus 100) a computer-readable storage medium containing control program code (executable program, intermediate code program, or source program) for the fixing units 30, 130, and 230, which is software realizing the aforementioned functions, in order for the computer (or CPU or MPU) to retrieve and execute the program code contained in the storage medium.

As the recording medium, for example, (i) a tape such as a magnetic tape or a cassette tape, (ii) a disc including a magnetic disc such as a floppy (registered trademark) disc or a hard disc, and an optical disc such as a CD-ROM, an MO, an MD, a DVD or a CD-R, (iii) a card such as an IC card (including a memory card) or an optical card, or (iv) a semiconductor memory such as a masked ROM, an EPROM, an EEPROM or a flash ROM.

Further, each of the fixing units 30, 130, and 230 (or the image forming apparatus 100) may be arranged so as to be able to be connected with a communication network, so that the program code can thereby be provided via the communication network. The communication network is not particularly limited, and can be the Internet, an intranet, an extranet, a LAN, an ISDN, a VAN, a CATV communication network, a virtual private network, a telephone network, a mobile communication network, or a satellite communication network, for example. In addition, the transmission medium of the communication network is not particularly limited. Therefore, cable communication with use of an IEEE1394, a USB, a power line carrier, a cable TV line, a telephone line or an ADSL, for example, is possible. Further, radio communication with use of an infrared radiation of the IrDA standard or of a remote control, a Bluetooth (registered trademark), an 802.11 wireless network, an HDR, a mobile phone network, a satellite connection or a digital terrestrial network, for example, is possible. The present invention can be achieved by use of a computer data signal embodied in a carrier wave which signal is formed by electronic transmission of the program code.

Additionally, the control section 91 included in each of the fixing units 30, 130, and 230 is not necessarily realized by use of software, and may be operated by hardware logic. Alternatively, the control section 91 may be realized by a combination of (i) hardware which performs some of the controlling process and (ii) arithmetic means for executing software for controlling the hardware and for performing remaining controlling process.

As described above, a fixing device of the present invention includes: a fixing roller which is rotatably supported; a belt holding member; a fixing belt which is endless and which is rotatably held around the fixing roller and the belt holding member; first heating means for heating the fixing belt; a pressing member which is capable of being pressed against the fixing roller via the fixing belt; first driving means for driving the fixing roller to rotate; and a disjunction mechanism for switching a relative position of the pressing member and the fixing roller from a first position to a second position, or vice versa, the first position being a position at which the pressing member and the fixing roller are pressed against each other via the fixing belt, the second position being a position at which the pressing member and the fixing belt are separated from each other; the fixing device fixing an unfixed toner image, formed on a recording material, to the recording material by causing the recording material to pass through a nip at which the fixing belt and the pressing member are pressed against each other, the fixing belt satisfying $$42.2 \geqq ER \geqq 0.1044 \times D \times \mu^{-0.5174},$$

where: D (mm) represents a first inner diameter of a loop of the fixing belt held in a state where the fixing belt is looped in a shape of a circle without suspension; A (mm) represents a second inner diameter of the fixing belt, the second inner diameter being a distance between respective axial centers of a supporting member and a spindle in a state where the fixing belt is held with a tensile load of 0.383 gf/mm by (i) suspending the fixing belt from the supporting member inserted in a loop of the fixing belt, and (ii) further inserting the spindle in the loop of the fixing belt, the supporting member and the spindle having a shape of a roller with a diameter of 0.26×D (mm); ER represents an elongation rate (%) of the fixing belt and is formulated as $$ER=(A-D)/D\times 100;\text{ and}$$

μ represents a coefficient of kinetic friction between the fixing belt and the fixing roller, the fixing belt being driven by the fixing roller to rotate in a case where the fixing roller is driven by the first driving means to rotate in a state where the relative position is set to the second position.

According to the above arrangement, the fixing belt satisfies $42.2 \geqq ER \geqq 0.1044\times D\times \mu^{-0.5174}$. The fixing belt satisfying this condition can be driven by the fixing roller to rotate in the case where the fixing roller is driven by the first driving means to rotate in the state where the relative position is set to the second position.

The above arrangement allows the pressing member to be separated from the fixing belt when no recording material is passed through the nip. This prevents the fixing belt from being damaged due to its abutment on the pressing member, and can in turn allow the fixing belt to have a longer life. The above arrangement, even without providing an auxiliary roller as in Patent Literature 2, allows the fixing belt to be driven by the fixing roller to rotate in the state where the pressing member is separated from the fixing belt. This prevents heat of the fixing belt from being drawn to such an auxiliary roller. Consequently, it is possible to shorten a warm-up time and to reduce power consumption. In addition, the above arrangement allows heat transferred from the first heating means to the fixing belt to be transferred uniformly over a surface of the fixing roller so that the fixing roller is heated. This prevents a temperature of the fixing roller from decreasing when no recording material is passed through the nip. As a result, it is possible to stabilize a fixing property observed immediately after a warm-up or immediately after the image forming apparatus becomes ready on standby.

The fixing device may further include second driving means for driving the pressing member to rotate.

The above arrangement allows the pressing member to be driven to rotate with use of a driving force transmitted from the second driving means. As compared to an arrangement in which the pressing member is driven by the fixing roller to rotate, the above arrangement reduces a load which acts upon the fixing roller in the state where the relative position is set to the first position. This prevents damage to the fixing roller.

Each of the first driving means and the second driving means may use a driving force transmitted from a common driving source.

The above arrangement simplifies the arrangement of the fixing device as compared to a case in which the first driving means and the second driving means use their respective driving sources. Further, the use of driving forces transmitted from the common driving source makes it possible to easily rotate the fixing roller, the fixing belt, and the pressing member at a synchronous speed (at which these sections move in the pressure area).

The fixing device may further include a control section for controlling an operation of the disjunction mechanism so that the relative position is set to the second position in a warm-up mode and a standby mode, wherein the warm-up mode is a mode, in which a temperature of the fixing belt is raised to a predetermined temperature and the standby mode is a mode, in which the temperature of the fixing belt is maintained within a predetermined temperature range after a predetermined period has elapsed without passing a recording material through the nip.

The above arrangement allows the pressing member to be separated from the fixing belt in the warm-up mode and the standby mode. This prevents damage to the fixing belt, and thus allows the fixing belt to have a longer life.

The fixing device may further include temperature detecting means for detecting a temperature of a surface of the fixing roller, and be arranged such that the control section has a function of controlling an operation of the first driving means so that in the warm-up mode and the standby mode, (i) the fixing roller is driven to rotate in a case where the temperature of the surface of the fixing roller is lower than a control target temperature and that (ii) the fixing roller is not driven to rotate in a case where the temperature of the surface of the fixing roller is not lower than the control target temperature.

According to the above arrangement, the fixing roller is driven to rotate in the case where the temperature of the surface of the fixing roller is lower than the control target temperature in the warm-up mode and the standby mode. This allows the heat of the fixing belt to be uniformly transferred to the fixing roller along the circumferential direction so that the fixing roller is heated. In the case where the temperature of the surface of the fixing roller is not lower than the control target temperature, the fixing roller is not driven to rotate. This prevents an excessive temperature rise in the fixing roller. It is thus possible to control the temperature of the fixing roller so that the temperature of the fixing roller will be equal to the control target temperature. As a result, in a case where a fixing process is performed after the warm-up mode or the standby mode, the above arrangement makes it possible to rapidly start the fixing process and to achieve a stable fixing property.

The fixing device may further include second heating means for heating the pressing member.

The above arrangement allows the pressing member to be heated in the state where the pressing member is separated from the fixing belt. The fixing belt and the pressing member are separated from each other when no recording material is passed through the nip. This prevents an excessive temperature rise in the pressing member, and further makes it possible to independently control the respective temperatures of the fixing belt and the pressing member. As a result, it is possible to (i) rapidly start a fixing process to be performed and to (ii) achieve a stable fixing property.

The fixing device may be arranged such that: the belt holding member is a roller-shaped member which has a shape of a cylinder and which is rotatably supported; the first heating means is contained in the belt holding member; and the fixing belt is heated via the belt holding member.

According to the above arrangement, the first heating means is provided inside the belt holding member. This makes it possible to downsize the fixing device.

The fixing device may be arranged such that the belt holding member is a member having a rounded surface abutting the fixing belt; the fixing belt is configured to slide on the abutting surface; the first heating means is a plate-shaped heater which sandwiches the belt holding member with the abutting surface.

According to the above arrangement, the use of the plate-shaped heater makes it possible to selectively heat an area on a surface of the plate-shaped member, the surface being located opposite from a surface abutting the fixing belt. This improves heating efficiency.

The fixing device may be arranged such that the first heating means additionally has a function of the belt holding member.

As compared to the case in which the first heating means and the belt holding member are provided as separate members, the above arrangement not only simplifies the arrangement of the fixing device and thus downsizes the fixing device, but also reduces the cost by reducing the number of components included in the fixing device.

The fixing device may be arranged such that the pressing member includes: a pressing roller; second belt holding member; and a pressing belt which is held around the pressing roller and the second belt holding member; the pressing belt is pressed against the fixing roller via the fixing belt in a case where the relative position is set to the first position; and a recording material on which an unfixed toner image is formed is passed through a nip between the fixing belt and the pressing belt so that the unfixed toner image is fixed on the recording material.

The above arrangement makes it possible to increase the fixing nip area, in which the fixing belt and the pressing belt are pressed against each other. This allows the heat of the fixing belt to be efficiently transferred to the recording material. As a result, it is possible to stabilize the fixing property.

An image forming apparatus of the present invention includes any one of the above fixing devices. As such, it is possible to prevent the fixing belt from deteriorating due to the pressure applied from the pressing member. Further, it is also possible to prevent the temperature of the pressing member from excessively rising due to its abutment on the fixing belt. In addition, it is also possible to reduce the warm-up time and thus to reduce power consumption. The present invention is not limited to the description of the embodiments above, but may be altered by a skilled person within the scope of the claims. Any embodiment based on a proper combination of technical means disclosed in different embodiments is also encompassed in the technical scope of the present invention.

Industrial Applicability

The present invention is applicable to a fixing device which uses a belt fixing method and which is included in an electrophotographic image forming apparatus, and also to an image forming apparatus including the fixing device.

Reference Signs List

| | |
|---|---|
| 30 | fixing unit (fixing device) |
| 31 | fixing roller |
| 31e | thermistor (temperature detecting means) |
| 32 | pressing roller (pressing member) |
| 33 | heat roller (belt holding member; first heating means) |
| 33d | heater lamp (first heating means) |
| 34 | fixing belt |
| 35 | supporting member |
| 36 | spindle (supporting member) |
| 37 | fixing roller driving means (first driving means) |
| 40 | automatic pressure removing mechanism (disjunction mechanism) |
| 100 | image forming apparatus |
| 130 | fixing unit (fixing device) |
| 133 | plate-shaped heating member (belt holding member; first heating means) |
| 133a | heat diffusing member (belt holding member; plate-shaped member) |
| 133d | PTC ceramic heater (first heating means; plate-shaped heater) |
| 230 | fixing unit (fixing device) |
| 232 | pressing belt (pressing member) |
| 238 | tension roller (second belt holding member) |

-continued

Reference Signs List

| | |
|---|---|
| ER | elongation rate |
| N | fixing nip area |
| P | recording material |
| μ | coefficient of kinetic friction |

The invention claimed is:

1. A fixing device, comprising:

a fixing roller which is rotatably supported;

a belt holding member;

a fixing belt which is endless and which is rotatably held around the fixing roller and the belt holding member;

first heating means for heating the fixing belt;

a pressing member which is capable of being pressed against the fixing roller via the fixing belt;

first driving means for driving the fixing roller to rotate; and a disjunction mechanism for switching a relative position of the pressing member and the fixing roller from a first position to a second position, or vice versa, the first position being a position at which the pressing member and the fixing roller are pressed against each other via the fixing belt, the second position being a position at which the pressing member and the fixing belt are separated from each other;

the fixing device fixing an unfixed toner image, formed on a recording material, to the recording material by causing the recording material to pass through a nip at which the fixing belt and the pressing member are pressed against each other, the fixing belt satisfying $$42.2 \geqq ER \geqq 0.1044 \times D \times \mu^{-0.5174},$$

where:

D (mm) represents a first inner diameter of a loop of the fixing belt held in a state where the fixing belt is looped in a shape of a circle without suspension;

A (mm) represents a second inner diameter of the fixing belt, the second inner diameter being a distance between respective axial centers of a supporting member and a spindle in a state where the fixing belt is held with a tensile load of 0.383 gf/mm by (i) suspending the fixing belt from the supporting member inserted in a loop of the fixing belt, and (ii) further inserting the spindle in the loop of the fixing belt, the supporting member and the spindle having a shape of a roller with a diameter of 0.26×D (mm);

ER represents an elongation rate (%) of the fixing belt and is formulated as $$ER=(A-D)/D \times 100; \text{ and}$$

μ represents a coefficient of kinetic friction between the fixing belt and the fixing roller, the fixing belt being driven by the fixing roller to rotate in a case where the fixing roller is driven by the first driving means to rotate in a state where the relative position is set to the second position.

2. The fixing device according to claim 1, further comprising second driving means for driving the pressing member to rotate.

3. The fixing device according to claim 2, wherein each of the first driving means and the second driving means uses a driving force transmitted from a common driving source.

4. The fixing device according to claim 1, further comprising a control section for controlling an operation of the disjunction mechanism so that the relative position is set to the second position in a warm-up mode and a standby mode, wherein the warm-up mode is a mode, in which a temperature of the fixing belt is raised to a predetermined temperature and the standby mode is a mode, in which the temperature of the fixing belt is maintained within a predetermined temperature range after a predetermined period has elapsed without passing a recording material through the nip.

5. The fixing device according to claim 4, further comprising temperature detecting means for detecting a temperature of a surface of the fixing roller, wherein the control section has a function of controlling an operation of the first driving means so that in the warm-up mode and the standby mode, (i) the fixing roller is driven to rotate in a case where the temperature of the surface of the fixing roller is lower than a control target temperature and that (ii) the fixing roller is not driven to rotate in a case where the temperature of the surface of the fixing roller is not lower than the control target temperature.

6. The fixing device according to claim 1, further comprising second heating means for heating the pressing member.

7. The fixing device according to claim 1, wherein:

the belt holding member is a roller-shaped member which has a shape of a cylinder and which is rotatably supported;

the first heating means is contained in the belt holding member; and the fixing belt is heated via the belt holding member.

8. The fixing device according to claim 1, wherein:

the belt holding member is a member having a rounded surface abutting the fixing belt;

the fixing belt is configured to slide on the abutting surface;

the first heating means is a plate-shaped heater which sandwiches the belt holding member with the abutting surface.

9. The fixing device according to claim 1, wherein the first heating means additionally has a function of the belt holding member.

10. The fixing device according to claim wherein:

the pressing member includes:

a pressing roller;

second belt holding member; and a pressing belt which is held around the pressing roller and the second belt holding member;

the pressing belt is pressed against the fixing roller via the fixing belt in a case where the relative position is set to the first position; and a recording material on which an unfixed toner image is formed is passed through a nip between the fixing belt and the pressing belt so that the unfixed toner image is fixed on the recording material.

11. An image forming apparatus, comprising:

a fixing device including:

a fixing roller which is rotatably supported;

a belt holding member;

a fixing belt which is endless and which is rotatably held around the fixing roller and the belt holding member;

first heating means for heating the fixing belt;

a pressing member which is capable of being pressed against the fixing roller via the fixing belt;

first driving means for driving the fixing roller to rotate; and a disjunction mechanism for switching a relative position of the pressing member and the fixing roller from a first position to a second position, or vice versa, the first position being a position at which the pressing member and the fixing roller are pressed against each other via the fixing belt, the second position being a position at which the pressing member and the fixing belt are separated from each other;

the fixing device fixing an unfixed toner image, formed on a recording material, to the recording material by causing the recording material to pass through a nip at which the fixing belt and the pressing member are pressed against each other, the fixing belt satisfying $$42.2 \geqq ER \geqq 0.1044 \times D \times \mu^{-0.5174},$$

where:

D (mm) represents a first inner diameter of a loop of the fixing belt held in a state where the fixing belt is looped in a shape of a circle without suspension;

A (mm) represents a second inner diameter of the fixing belt, the second inner diameter being a distance between respective axial centers of a supporting member and a spindle in a state where the fixing belt is held with a tensile load of 0.383 gf/mm by (i) suspending the fixing belt from the supporting member inserted in a loop of the fixing belt, and (ii) further inserting the spindle in the loop of the fixing belt, the supporting member and the spindle having a shape of a roller with a diameter of 0.26×D (mm);

ER represents an elongation rate (%) of the fixing belt and is formulated as $$ER = (A - D)/D \times 100; \text{ and}$$

μ represents a coefficient of kinetic friction between the fixing belt and the fixing roller, the fixing belt being driven by the fixing roller to rotate in a case where the fixing roller is driven by the first driving means to rotate in a state where the relative position is set to the second position.

* * * * *